US009228483B2

(12) United States Patent
Kuze

(10) Patent No.: US 9,228,483 B2
(45) Date of Patent: Jan. 5, 2016

(54) FLUID CONTROL SYSTEM

(75) Inventor: Yasuhiro Kuze, Numazu (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 252 days.

(21) Appl. No.: 14/115,250

(22) PCT Filed: May 20, 2011

(86) PCT No.: PCT/JP2011/061646

§ 371 (c)(1),
(2), (4) Date: Nov. 1, 2013

(87) PCT Pub. No.: WO2012/160621

PCT Pub. Date: Nov. 29, 2012

(65) Prior Publication Data

US 2014/0069522 A1 Mar. 13, 2014

(51) Int. Cl.

| | |
|---|---|
| ***F01P 7/02*** | (2006.01) |
| ***F01P 7/16*** | (2006.01) |
| ***F01P 7/14*** | (2006.01) |
| *F01P 3/02* | (2006.01) |

(52) U.S. Cl.

CPC ... *F01P 7/16* (2013.01); *F01P 7/14* (2013.01); *F01P 7/165* (2013.01); *F01P 2003/028* (2013.01); *F01P 2031/32* (2013.01); *Y10T 137/6416* (2015.04); *Y10T 137/86493* (2015.04)

(58) Field of Classification Search

CPC ..... F01P 7/16; F01P 7/14; F01P 7/165; F01P 2003/028; F01P 2031/32; F01P 3/00; F01P 7/167; F01P 2060/08; F01P 3/20; F01P 11/06; F01P 11/04; F01P 2007/146; Y10T 137/86493; Y10T 137/6416

See application file for complete search history.

(56) References Cited

U.S. PATENT DOCUMENTS

| | | | | |
|---|---|---|---|---|
| 6,065,682 | A * | 5/2000 | Frunzetti | F01P 7/16 236/12.15 |
| 6,481,387 | B1 | 11/2002 | Sano | |
| 8,181,610 | B2 * | 5/2012 | Dipaola | F01P 7/165 123/41.01 |
| 2014/0007824 | A1 | 1/2014 | Hayashi et al. | |

FOREIGN PATENT DOCUMENTS

| | | | |
|---|---|---|---|
| JP | 06-137148 | A | 5/1994 |
| JP | 07-091251 | A | 4/1995 |
| JP | 11-117799 | A | 4/1999 |
| JP | 2003-506616 | A | 2/2003 |
| JP | 2009-097351 | A | 5/2009 |
| JP | 2010-247657 | A | 11/2010 |
| JP | 5240403 | B2 | 4/2013 |
| WO | 2012/127555 | A1 | 9/2012 |

* cited by examiner

*Primary Examiner* — M. Alexandra Elve
*Assistant Examiner* — Larry Furdge
(74) *Attorney, Agent, or Firm* — Sughrue Mion, PLLC

(57) ABSTRACT

A first fluid system includes a thermostat portion T, a valve portion V, and an ECU 30A. The thermostat portion T includes a first thermostat 18 in a first divergent pathway PB1 and a second thermostat 19 in a second divergent pathway PB2. The valve portion V includes a valve mechanism in at least a second portion SG2 of portions SG1, SG2, SG3. In the ECU 30A, achieved is a control unit that controls the valve portion V to switch a flow control state of at least one of the valve mechanism of the valve portion V when one of an open failure and a close failure occurs in one of the thermostats 18, 19.

8 Claims, 13 Drawing Sheets

FLUID CONTROL SYSTEM

CROSS REFERENCE TO RELATED APPLICATIONS

This application is a National Stage of International Application No. PCT/JP2011/061646filed May 20, 2011, the contents of all of which are incorporated herein by reference in their entirety.

TECHNICAL FIELD

The present invention relates to a fluid control system.

BACKGROUND ART

Patent Document 1 discloses technology considered to be relevant to the present invention as technology to control a fluid such as a coolant of the engine. Patent Document 1 discloses a cooling system of an internal-combustion engine that sets a high water temperature or a low water temperature by using a high-temperature thermo-valve and a low-temperature thermo-valve.

In addition, Patent Documents 2 through 4 disclose technology related to a failure of a thermostat as technology considered to be relevant to the present invention. Patent Document 2 discloses an engine cooling system failure detecting device that detects a failure of a thermostat. Patent Document 3 discloses a cooling control system of an internal-combustion engine that circulates a cooling medium through a cyclic path having a heat exchanger that releases heat when a failure occurs in a thermostat valve. Patent Document 4 discloses a cooling system of an engine that includes an electric thermostat that opens and closes in accordance with higher temperature between temperature of cooling water and temperature of an electric heater to open and close in accordance with the temperature of cooling water even when a failure occurs in the electric heater.

PRIOR ART DOCUMENT

Patent Document

[Patent Document 1] Japanese Patent Application Publication No. 7-91251

[Patent Document 2] Japanese Patent Application Publication No. 11-117799

[Patent Document 3] Japanese Patent Application Publication No. 2003-506616

[Patent Document 4] Japanese Patent Application Publication No. 2009-97351

SUMMARY OF THE INVENTION

Problems to be Solved by the Invention

A thermostat may be provided to properly cool a cooling object. The cooling object may be cooled by using the thermostat as follows, for example. That is to say, first and second divergent pathways that diverge and then converge are located in a fluid supply pathway that supplies a fluid to the cooling object, and a thermostat is located in at least one of the divergent pathways. In this case, the provision of a valve mechanism downstream of one of the thermostats enables to activate and deactivate the fluid distribution control by the corresponding thermostat. This enables to arbitrarily control the distribution of the fluid by the thermostat.

In this case, however, when a close failure that causes the corresponding thermostat to be kept closed occurs in the corresponding thermostat while the fluid distribution control by the thermostat is activated, for example, the supply of the fluid through the corresponding thermostat becomes impossible. This may result in deterioration of the state of the cooling object due to lack of cooling. In addition, when an open failure that causes the corresponding thermostat to be kept open occurs while the fluid distribution control by the thermostat is activated, it becomes impossible to properly stop supplying the fluid through the corresponding thermostat. This may result in deterioration of the state of the cooling object due to supercooling.

It may be considered to implement measures based on failed state in order to take measures against the failure of the thermostat. More specifically, the following measures may be taken for example when the cooling object is an engine installed in a vehicle.

That is to say, when the close failure occurs in the thermostat, the output of the engine is restrained to avoid overheat. In this case, however, kinematic performance of the vehicle decreases. In addition, the failure may remain unfixed till the repair is finished when the open failure occurs in the thermostat. In this case, however, the internal friction of the engine increases, and thus fuel economy decreases. At the same time, the heater performance decreases when the vehicle have a heater that generates heat by using heat received from the coolant of the engine. Therefore, various inconveniences may occur in this case while it can be said that the failure occurs in the thermostat. Thus, desired is a technique that prevents the deterioration of the cooling state of an object that is the cooling object and to which the fluid is to be supplied even when the failure occurs in the thermostat.

The present invention has been made in view of above problems, and aims to provide a fluid control system that enables to perform fluid distribution control by thermostats by activating or deactivating the fluid distribution control by at least one of the thermostats located in divergent pathways that diverge and then converge and can prevent the deterioration of the cooling state of a supplying object even when the open failure or the close failure occurs in one of the thermostats.

Means for Solving the Problems

The present invention is a fluid control system including: a thermostat portion that includes a first thermostat in a first divergent pathway and a second thermostat of which an open valve temperature is set to be less than that of the first thermostat in a second divergent pathway, the first and second divergent pathways diverging and then converging; a valve portion that includes a valve mechanism in at least a second portion out of a first portion that is a portion located more downstream than the first thermostat in the first divergent pathway, the second portion that is a portion located more downstream than the second thermostat in the second divergent pathway, and a third portion that is a portion lying posterior to a point at which the first and second divergent pathways converge in a fluid supply pathway that includes the first and second divergent pathways and supplies a fluid to a supplying object; and a control unit that controls the valve portion to switch a distribution control state of at least one valve mechanism of the valve mechanism of the valve portion when one of an open failure that causes a thermostat to be kept open and a close failure that causes a thermostat to be kept closed occurs in one of the first and second thermostats.

The present invention may have a configuration in that the control unit controls, when the close failure occurs in one thermostat of the first and second thermostats, the valve portion to increase a flow volume of the fluid distributed through another thermostat by switching the distribution control state of at least one valve mechanism of the valve mechanism of the valve portion.

The present invention may have a configuration in that the control unit increases a flow volume of the fluid distributed through the second thermostat by controlling the valve portion to lift at least a restriction on distribution of the fluid through the second divergent pathway when the close failure occurs in the first thermostat while the valve portion restricts at least the distribution of the fluid through the second divergent pathway and does not restrict distribution of the fluid through a high-temperature side supply pathway that is capable of supplying the fluid to the supplying object through the first divergent pathway in the fluid supply pathway, and restricts the distribution of the fluid through the second divergent pathway.

The present invention may have a configuration in that a cooler that cools the fluid flowing at upstream sides of the first and second divergent pathways; a bypass pathway that distributes the fluid around the cooler to a portion located more downstream than the second thermostat in the second divergent pathway; and a bypass valve that operates in conjunction mechanically with the second thermostat, and opens the bypass pathway when the second thermostat is closed and blocks the bypass pathway when the second thermostat is open, wherein the valve portion includes a valve mechanism in at least the second portion, the valve mechanism being located more downstream than the bypass valve in the second portion, and the control unit increases a flow volume of the fluid distributed through the first thermostat by controlling the valve portion to restrict at least the distribution of the fluid through the second divergent pathway when the close failure occurs in the second thermostat while the valve portion lifts a restriction on distribution of the fluid through a low-temperature side supply path that is capable of supplying the fluid to the supplying object through the second divergent pathway in the fluid supply pathway by lifting at least a restriction on the distribution of the fluid through the second divergent pathway.

The present invention may have a configuration in that the valve portion includes valve mechanisms in two portions, including the second portion, out of the first, second, and third portions.

The present invention may have a configuration in that the control unit controls the valve portion to decrease a flow volume of the fluid distributed through the third portion by controlling the valve portion to switch the distribution control state of at least one valve mechanism of the valve mechanism of the valve portion when the open failure occurs in one of the first and second thermostats.

The present invention may have a configuration in that the valve portion includes valve mechanisms in two or more portions, including the second portion, out of the first, second, and third portions, and the control unit decreases a flow volume of the fluid distributed through the third portion by controlling the valve portion to restrict at least distribution of the fluid through a high-temperature side supply pathway when the open failure occurs in the first thermostat while the valve portion lifts a restriction on the distribution of the fluid through the high-temperature side supply pathway that is capable of supplying the fluid to the supplying object through the first divergent pathway in the fluid supply pathway and restricts distribution of the fluid through the second divergent pathway.

The present invention may have a configuration in that the control unit decreases a flow volume of the fluid distributed through the third portion by controlling the valve portion to restrict distribution of the fluid through the second divergent pathway when the open failure occurs in the second thermostat while the valve portion lifts a restriction on distribution of the fluid through a low-temperature side supply path that is capable of supplying the fluid to the supplying object through the second divergent pathway in the fluid supply pathway by lifting at least the restriction on the distribution of the fluid through the second divergent pathway.

The present invention may have a configuration in that the valve portion includes a single-axis rotary valve body located in two portions, including the second portion, of the first, second, and third portions to include respective valve mechanisms in the two portions, including the second portions, of the first, second, and third portions.

Effects of the Invention

The present invention enables to perform fluid distribution control by thermostats by activating or deactivating the fluid distribution control by at least one of the thermostats located in divergent pathways that diverge and then converge and can prevent the deterioration of the cooling state of a supplying object even when an open failure or a close failure occurs in one of the thermostats.

MODES FOR CARRYING OUT THE INVENTION

A description will be given of embodiments of the present invention with reference to the drawings.

First Embodiment

Figure 1:
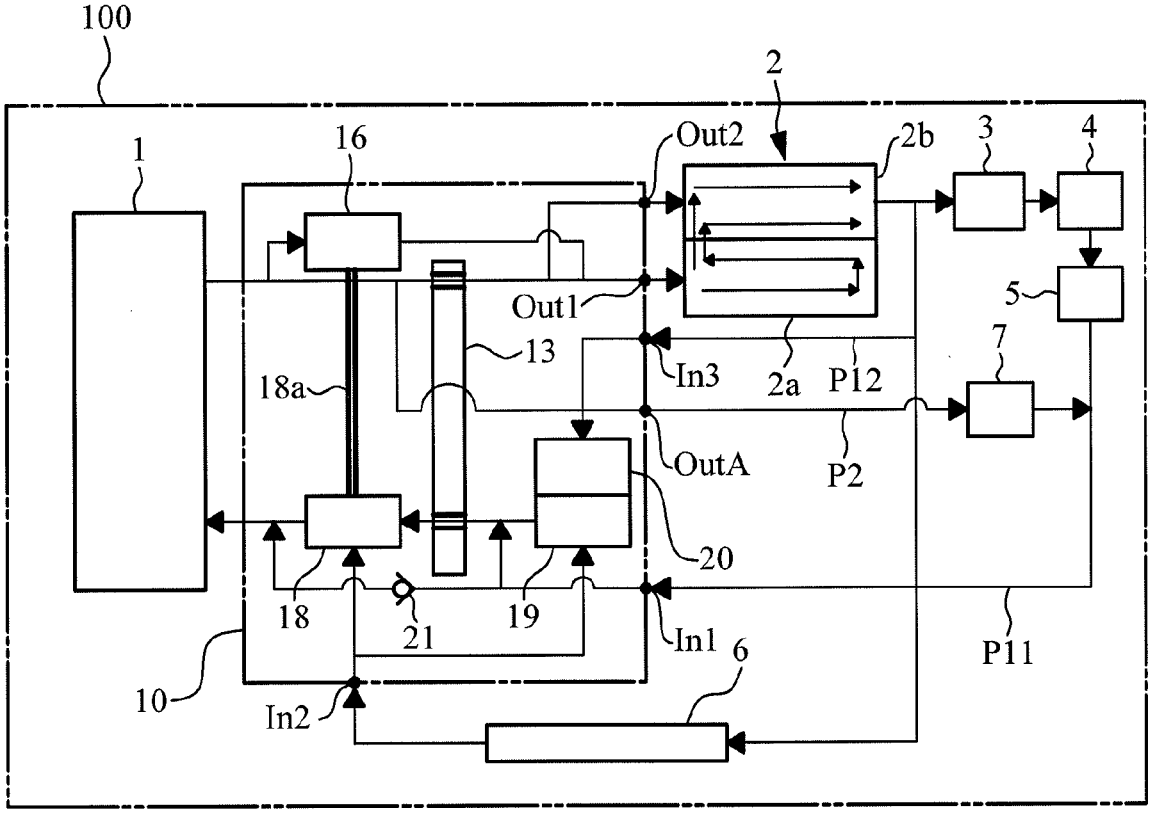
FIG. 1 is a schematic configuration diagram of a cooling circuit of an engine.

FIG. 1 is a schematic configuration diagram of a cooing circuit 100 of an engine (hereinafter, referred to as a cooing circuit). The cooing circuit 100 includes a water pump (hereinafter, described as a W/P) 1, an engine 2, an oil cooler 3, a heater 4, an ATF (Automatic Transmission Fluid) warmer 5, a radiator 6, an electronic control throttle 7, and a rotary valve 10. The cooing circuit 100 is installed in a vehicle that is not illustrated.

The W/P 1 circulates coolant, which is a fluid, of the engine 2. The W/P 1 is a mechanical pump driven by output of the engine 2. The W/P 1 may be an electric driven pump. The coolant discharged from the W/P 1 flows in the engine 2 and the electronic control throttle 7 through the rotary valve 10. When flowing in the engine 2, the coolant flows out from the rotary valve 10 through outlet portions Out1, Out2. In addition, when flowing in the electronic control throttle 7, the coolant flows out from the rotary valve 10 through an outlet portion OutA.

The engine 2 includes a cylinder block 2*a* and a cylinder head 2*b*. The engine 2 has a cooling passage described below. That is to say, provided is the cooling passage that causes the coolant flowing in from the outlet portion Out1 to flow through the cylinder block 2*a* and the cylinder head 2*b* in this order, causes the coolant flowing in from the outlet portion Out2 to flow through the cylinder head 2*b*, merges them at the cylinder head 2*b*, and causes the merged coolant to flow out from the cylinder head 2*b*.

A part of the coolant that has flowed through the engine 2 flows through the oil cooler 3, the heater 4, and the ATF warmer 5 while the remaining coolant flows through the radiator 6. The oil cooler 3 exchanges heat between the lubricating oil of the engine 2 and the coolant to cool the lubricating oil. The heater 4 exchanges heat between air and the coolant to heat the air. The heated air is used to heat the vehicle interior. The ATF warmer 5 exchanges heat between the ATF and the coolant to heat the ATF. The radiator 6 is a cooler, and exchanges heat between air and the coolant to cool the coolant.

The coolant that has flowed through the oil cooler 3, the heater 4, and the ATF warmer 5 returns to the W/P 1 through the rotary valve 10. At this time, the coolant flows in the rotary valve 10 through an inlet portion In1. In addition, the coolant that has flowed through the radiator 6 flows in the rotary valve 10 through an inlet portion In2. A distribution pathway passing through the oil cooler 3, the heater 4, and the ATF warmer is a first radiator bypass pathway P11 that bypasses the radiator 6.

The coolant flowing in the electronic control throttle 7 flows through the electronic control throttle 7 and then joins the first radiator bypass pathway P11. The coolant can be flowed through the electronic control throttle 7 to prevent the malfunction due to freezing. A distribution pathway passing through the electronic control throttle 7 is an engine bypass pathway P2 that bypasses the engine 2.

In the cooing circuit 100, a part of the coolant that has flowed through the engine 2 further flows in the rotary valve 10 through an inlet portion In3. The distribution pathway is a second radiator bypass pathway P12 that bypasses the radiator 6. Thus, the coolant distributed through the first radiator bypass pathway P11 flows in the rotary valve 10 through the inlet portion In1. In addition, the coolant distributed through the second radiator bypass pathway P12 flows in it through the inlet portion In3.

Figure 2:
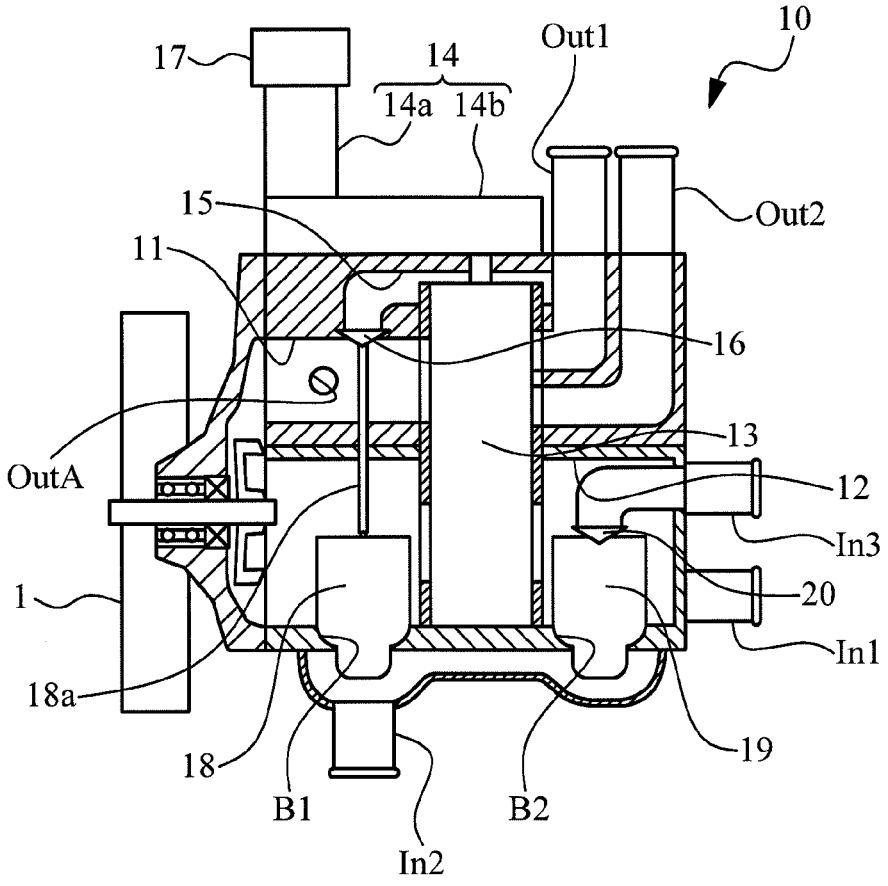
FIG. 2 is a schematic configuration diagram of a rotary valve.

FIG. 2 is a schematic configuration diagram of the rotary valve 10. FIG. 2 also illustrates the W/P 1 together with the rotary valve 10. As illustrated in FIG. 1 and FIG. 2, the rotary valve 10 includes a first passage portion 11, a second passage portion 12, a rotary valve body 13, a drive unit 14, a valve body bypass passage portion 15, a first bypass valve 16, a detecting unit 17, a first thermostat 18, a second thermostat 19, a second bypass valve 20, and a check valve 21. In addition, it includes the inlet portions In1, In2, In3 and the outlet portion Out1, Out2. FIG. 2 omits the illustration of the check valve 21 for convenience sake.

The first passage portion 11 is located between the coolant outlet portion of the W/P 1 and the engine 2, and passes the coolant. The second passage portion 12 is located between the coolant inlet portion of the W/P 1 and the radiator 6, and passes the coolant. The passage portions 11, 12 are arranged next to each other. The passage portions 11, 12 are connected to the W/P 1 at the ends thereof while being arranged next to each other. The first passage portion 11 is connected to the coolant outlet portion of the pump 1 while the second passage portion 12 is connected to the coolant inlet portion of the pump 1. The W/P 1 side corresponds to an upstream side in the first passage portion 11 while the W/P 1 side corresponds to a downstream side in the second passage portion 12.

The first passage portion 11 is communicated with the outlet portions Out1, Out2 at the downstream side of the rotary valve body 13 and communicated with the outlet portion OutA at the upstream side of the rotary valve body 13. Thus, the outlet portions Out1, Out2 discharge the coolant from portions at the downstream side of the rotary valve body 13 in the first passage portion 11. In addition, the outlet portion OutA discharges the coolant from a portion at the upstream side of the rotary valve body 13 in the first passage portion 11.

The second passage portion 12 is communicated with the inlet portion In1 at the upstream side and the downstream side of the rotary valve body 13. Thus, the inlet portion In1 causes the coolant to flow into portions located more upstream and more downstream than the rotary valve body 13 in the second passage portion 12. For convenience sake, FIG. 2 omits the illustration of a state in which the inlet portion In1 is communicated with the upstream side and the downstream side of the second passage portion 12.

The second passage portion 12 is communicated with the inlet portion In2 at the upstream side and the downstream side of the rotary valve body 13. Therefore, the inlet portion In2 distributes the coolant to portions located more upstream and more downstream than the rotary valve body 13 in the second passage portion 12. The second passage portion 12 includes a first communicating portion B1 that communicates between the portion located more downstream than the rotary valve body 13 and the inlet portion In2 and a second communicating portion B2 that communicates between the portion located more upstream than the rotary valve body 13 and the inlet portion In2. Further, the second passage portion 12 is communicated with the inlet portion In3 at the upstream side of the rotary valve body 13.

The rotary valve body 13 is located so as to lie between the first passage portion 11 and the second passage portion 12. The rotary valve body 13 changes the distribution of the coolant flowing through the first passage portion 11 and the distribution of the coolant flowing through the second passage portion 12 by rotating operation. The rotary valve body 13 can put and lift the restriction on the distribution, including forbidding and permitting the distribution of the coolant flowing through the first passage portion 11 and the distribution of the coolant flowing through the second passage portion 12. The drive unit 14 includes an actuator 14*a* and a gearbox unit 14*b*, and drives the rotary valve body 13. The actuator 14*a* is an electric motor in particular.

The valve body bypass passage portion 15 communicates between the portion located more upstream than and the portion located more downstream than the rotary valve body 13 in the first passage portion 11. The first bypass valve 16 is a differential pressure regulating valve, and puts and lifts the restriction on (more specifically, forbids and permits) the distribution of the coolant through the valve body bypass passage portion 15 in accordance with differential pressure between the pressure of the coolant at the portion located more upstream than the rotary valve body 13 (upstream side pressure) and the pressure of the coolant at the portion located more downstream than the rotary valve body 13 (downstream side pressure) in the first passage portion 11.

More specifically, the first bypass valve 16 forbids the distribution of the coolant through the valve body bypass passage portion 15 when the magnitude of the differential pressure obtained by subtracting the downstream side pressure from the upstream side pressure is equal to or less than a predetermined magnitude, and permits the distribution of the coolant through the valve body bypass passage portion 15 when it is greater than the predetermined magnitude. The predetermined magnitude may be set to be greater than the magnitude of the maximum differential pressure in a normal state.

The first bypass valve 16 is configured to operate in conjunction mechanically with the first thermostat 18. The first thermostat 18 includes an operating shaft 18*a* that extends to lie between the passage portions 11 and 12 to connect to the first bypass valve 16. The operating shaft 18*a* drives the first bypass valve 16, and thereby the first bypass valve 16 permits the distribution of the coolant through the valve body bypass passage portion 15 when the first thermostat 18 is closed and forbids the distribution of the coolant through the valve body bypass passage portion 15 when the first thermostat 18 is open.

To configure the first bypass valve 16 to act as a differential pressure regulating valve and operate in conjunction mechanically with the first thermostat 18, the first bypass valve 16 may have an open valve structure that opens a valve by differential pressure and the whole of the first bypass valve 16 may be configured to operate in conjunction mechanically with the first thermostat 18, for example.

The detecting unit 17 is provided to a driving shaft of the actuator 14*a*. The detecting unit 17 detects the angle of rotation of the driving shaft of the actuator 14*a*. This enables to detect or estimate the phase of the rotary valve body 13. The detecting unit 17 may be provided to the rotating shaft of the rotary valve body 13.

The first thermostat 18 is located in the first communicating portion B1. The second thermostat 19 is located in the second communicating portion B2. Thus, the second passage portion 12 is communicated with the inlet portion In2 through the first thermostat 18 at the downstream side of the rotary valve body 13. This makes the second passage portion 12 communicated with the radiator 6 through the first thermostat 18 at the downstream side of the rotary valve body 13. In addition, the second passage portion 12 is communicated with the inlet portion In2 through the second thermostat 19 at the upstream side of the rotary valve body 13. This makes the second passage portion 12 communicated with the radiator 6 through the second thermostat 19 at the upstream side of the rotary valve body 13.

The open valve temperatures of the thermostats 18, 19 differ from each other. The open valve temperature of the second thermostat 19 is set to be lower than the open valve temperature of the first thermostat 18. The first thermostat 18 opens when the temperature of the coolant is greater than a predetermined value A, and closes when the temperature of the coolant is equal to or less than the predetermined value A. The second thermostat 19 opens when the temperature of the coolant is greater than a predetermined value B that is less than the predetermined value A, and closes when the temperature of the coolant is equal to or less than the predetermined value B.

The second bypass valve 20 is located to open or block the inlet portion In3. The second bypass valve 20 is configured to operate in conjunction mechanically with the second thermostat 19. More specifically, the second bypass valve 20 is connected to the driving shaft of the second thermostat 19 (illustration is omitted). The second bypass valve 20 permits the distribution of the coolant through the inlet portion In3 (i.e. the second radiator bypass pathway P12) when the second thermostat 19 is closed, and forbids the distribution of the coolant through the inlet portion In3 when the second thermostat 19 is open.

The check valve 21 controls the distribution of the coolant flowing in from the inlet portion In1. More specifically, the check valve 21 permits the flow from the upstream side to the downstream side and forbids the flow from the downstream side to the upstream side when the coolant that has flowed in from the inlet portion In1 flows in the upstream side and the downstream side of the second passage portion 12.

Figure 3A:
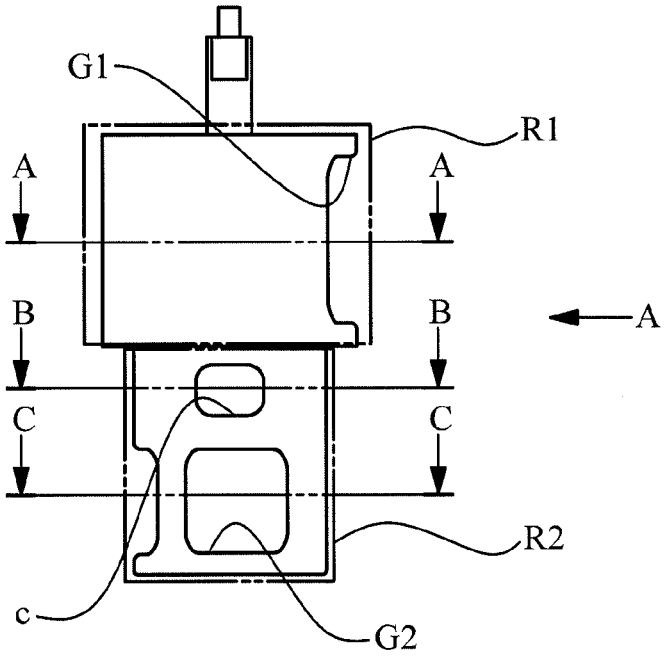
FIG. 3A is a diagram illustrating a rotary valve body as viewed from a side.
Figure 3B:
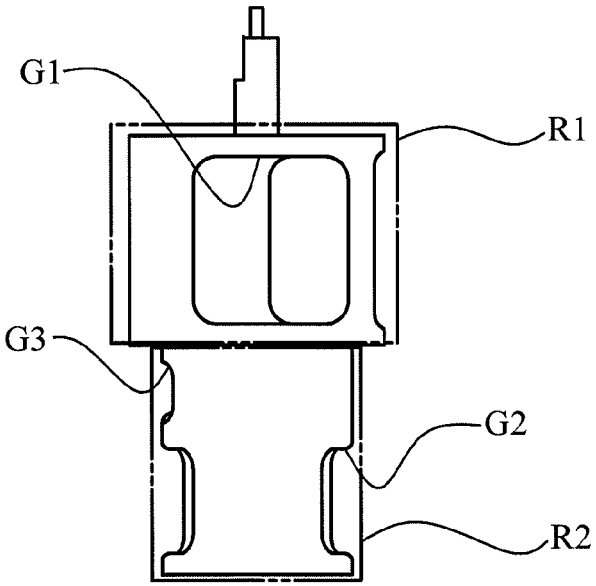
FIG. 3B is a diagram illustrating the rotary valve body as viewed from a direction indicated by an arrow A in FIG. 3A.
Figure 4A:
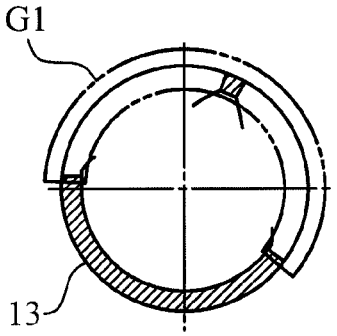
FIG. 4A is a cross-sectional view of the rotary valve body taken along line A-A in FIG. 3A.
Figure 4B:
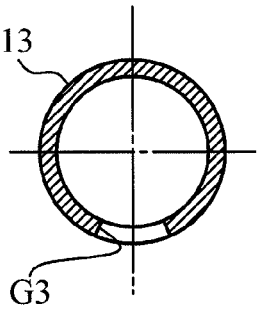
FIG. 4B is a cross-sectional view of the rotary valve body taken along line B-B in FIG. 3A.
Figure 4C:
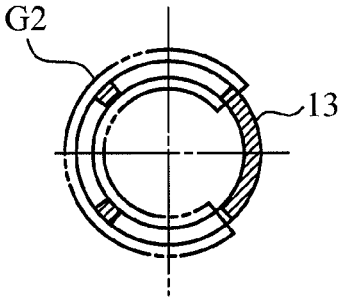
FIG. 4C is a cross-sectional view of the rotary valve body taken along line C-C in FIG. 3A.

FIG. 3A is a diagram illustrating the rotary valve body 13 as viewed from the side. FIG. 3B is a diagram illustrating the rotary valve body 13 as viewed from the direction indicated by the arrow A in FIG. 3A. FIG. 4A is a cross-sectional view of the rotary valve body 13 taken along line A-A in FIG. 3A, FIG. 4B is a cross-sectional view of the rotary valve body 13 taken along line B-B in FIG. 3A, and FIG. 4C is a cross-sectional view of the rotary valve body 13 taken along line C-C in FIG. 3A.

The rotary valve body 13 includes a first valve body portion R1 located in the first passage portion 11 and a second valve body portion R2 located in the second passage portion 12. The valve body portions R1, R2 are members of which the inside is cylindrically hollowed. The insides of the valve body portions R1, R2 are not communicated with each other.

The first valve body portion R1 includes a first opening portion G1, and the second valve body portion R2 includes a second opening portion G2. The opening portions G1, G2 are located so as to have different phases. The first opening portion G1 is formed by combining two opening portions divided by a supporting post, and the second opening portion G2 is formed by combining three opening portions divided by the supporting post.

The first opening portion G1 can permit the distribution of the coolant to the engine 2 while opening to the upstream side and the downstream side of the first passage portion 11. In addition, it can forbid the distribution of the coolant to the engine 2 while opening to only one of the upstream side and the downstream side of the first passage portion 11. The first opening portion G1 can also adjust the flow volume of the coolant distributed to the engine 2 in accordance with the phase of the rotary valve body 13 while opening to the upstream side and the downstream side of the first passage portion 11.

The second opening portion G2 can permit the distribution of the coolant through the second opening portion G2 while opening to the upstream side and the downstream side of the second passage portion 12. In addition, it can forbid the distribution of the coolant through the second opening portion G2 while opening to only one of the upstream side and the downstream side of the second passage portion 12.

The second valve body portion R2 further includes a third opening portion G3. The third opening portion G3 is located at a position different from that of the second opening portion G2 in the axis direction. The third opening portion G3 is provided so as to open to the downstream side of the second passage portion 12 when the second opening portion G2 is positioned at the downstream side of the second passage portion 12 while opening to the upstream side and the downstream side of the second passage portion 12. On the other hand, it is provided so as not to open to the upstream side of the second passage portion 12 when the second opening portion G2 is positioned at the upstream side of the second passage portion 12 while opening to the downstream side and the upstream side of the second passage portion 12.

Thus, the third opening portion G3 can permit the distribution of the coolant through the third opening portion G3 when positioned at the downstream side of the second passage portion 12. In addition, at this time, it can permit the distribution of the coolant through the opening portions G2, G3. On the other hand, the third opening portion G3 can forbid the distribution of the coolant through the third opening portion G3 when positioned at the upstream side of the second passage portion 12. At this time, it can permit the distribution of the coolant through the second opening portion G2 of the opening portions G2, G3.

When the third opening portion G3 is positioned at the upstream side of the second passage portion 12, the second opening portion G2 can gradually increase or decrease the flow volume of the coolant flowing from the upstream side to the downstream side of the second passage portion 12, between which the rotary valve body 13 lies, in accordance with the phase of the rotary valve body 13 while opening to the upstream side and the downstream side of the second passage portion 12. In addition, when the third opening portion G3 is positioned at the downstream side of the second passage portion 12, the opening portions G2, G3 can gradually increase or decrease the flow volume of the coolant flowing from the upstream side to the downstream side of the second passage portion 12, between which the rotary valve body 13 lies, in accordance with the phase of the rotary valve body 13 while opening to the upstream side and the downstream side of the second passage portion 12.

The rotary valve body 13 configured as described above can simultaneously control the flow of the coolant in the first passage portion 11 and the flow of the coolant in the second passage portion 12 by rotational movement.

More specifically, for example, the rotary valve body 13 can restrict (more specifically, forbid) the flow of the coolant from the upstream side to the downstream side of the second passage portion 12, between which the rotary valve body 13 lies, by the second valve body portion R2 at the same time as lift the restriction on (more specifically, permit) the flow of the coolant from the upstream side to the downstream side of the first passage portion 11, between which the rotary valve body 13 lies, by the first valve body portion R1. In addition, for example, it can lift the restriction on (more specifically, permit) the flow of the coolant from the upstream side to the downstream side of the second passage portion 12, between which the rotary valve body 13 lies, by the second valve body portion R2 at the same time as lift the restriction on (more specifically, permit) the flow of the coolant from the upstream side to the downstream side of the first passage portion 11, between which the rotary valve body 13 lies, by the first valve body portion R1.

Back to FIG. 1 and FIG. 2, the first passage portion 11 communicated with the outlet portion OutA at the upstream side of the rotary valve body 13 diverges with respect to the engine bypass pathway P2 at the upstream side of the rotary valve body 13. Thus, when the rotary valve body 13 forbids the distribution of the coolant to the engine 2 in the first passage portion 11, the rotary valve 10 can distribute the coolant to the engine bypass pathway P2.

More specifically, the first passage portion 11 can diverge so as to be capable of performing the distribution control described in the following in accordance with the phase of the rotary valve body 13. That is to say, it can diverge so as to be capable of forbidding the distribution of the coolant to the cylinder block 2*a* and the cylinder head 2*b* in accordance with the phase of the rotary valve body 13. In addition, it can diverge so as to be capable of forbidding the distribution of the coolant to the cylinder block 2*a* while permitting the distribution of the coolant to the cylinder head 2*b*. Further, it can diverge so as to be capable of permitting the distribution of the coolant to the cylinder block 2*a* and the cylinder head 2*b*.

To diverge as described above, the first passage portion 11 can particularly diverge so as to correspond to different phases of the rotary valve body 13. FIG. 2 illustrates the first passage portion 11 diverging so as to correspond to the same phase of the rotary valve body 13 for convenience sake. For example, even when the first passage portion 11 diverges so as to correspond to the same phase of the rotary valve body 13, the above described distribution control can be achieved by applying a structure same as that of the second valve body portion R2 to the first valve body portion R1 in the rotary valve body 13 and branching the first passage portion 11 so as to correspond to the opening portions G2, G3. When the coolant is supplied to the engine 2, the first passage portion 11 does not have to diverge at the downstream side of the rotary valve body 13. In this case, the coolant can be supplied to the cylinder block 2*a*, for example.

Figure 5:
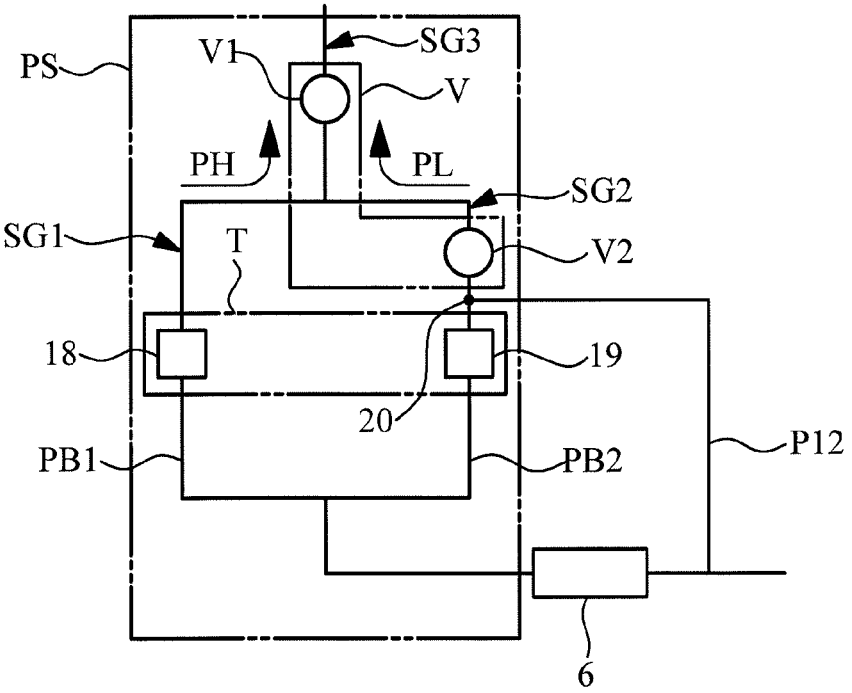
FIG. 5 is a diagram illustrating a fluid supply pathway.

FIG. 5 is a diagram illustrating a fluid supply pathway PS. The fluid supply pathway PS is a pathway that supplies the coolant to the object to which the coolant is to be supplied, i.e. the engine 2 that is a cooling object, and includes divergent pathways PB1, PB2 that diverge and then converge. The fluid supply pathway PS is a pathway that supplies the coolant from the radiator 6 to the engine 2. Thus, the radiator 6 cools the flowing coolant at the upstream side of the divergent pathways PB1, PB2. The first divergent pathway PB 1 specifically corresponds to a pathway arriving at the downstream side of the second passage portion 12 through the first communicating portion B1. The second divergent pathway PB2 specifically corresponds to a pathway arriving at the downstream side of the second passage portion 12 through the second communicating portion B2, the upstream side of the second passage portion 12, and the rotary valve 10.

A thermostat portion T includes a first thermostat 18 in the first divergent pathway PB1 and a second thermostat 19 in the second divergent pathway PB2. A valve portion V includes a first valve mechanism V1 in a third portion SG3 that is a portion lying posterior to a point at which the divergent pathways PB1, PB2 converge in the fluid supply pathway PS, and a second valve mechanism V2 in a second portion SG2 that is a portion located more downstream than the second thermostat 19 in the second divergent pathway PB2. Thus, a valve mechanism is included in at least the second portion SG2 of a first portion SG1 that is a portion located more downstream than the first thermostat 18 in the first divergent pathway PB 1, the second portion SG2, and the third portion SG3.

The second radiator bypass pathway P12 is located so as to distribute the coolant to the second portion SG2 around the radiator 6 with respect to the fluid supply pathway PS. The valve portion V includes the second valve mechanism V2 at a portion located more downstream than the second bypass valve 20 in the second portion SG2. A high-temperature side supply pathway PH is a pathway that can supply the coolant to the engine 2 through the first divergent pathway PB1 in the fluid supply pathway PS while a low-temperature side supply path PL is a pathway that can supply the coolant to the engine 2 through the second divergent pathway PB2 in the fluid supply pathway PS.

Figure 6:
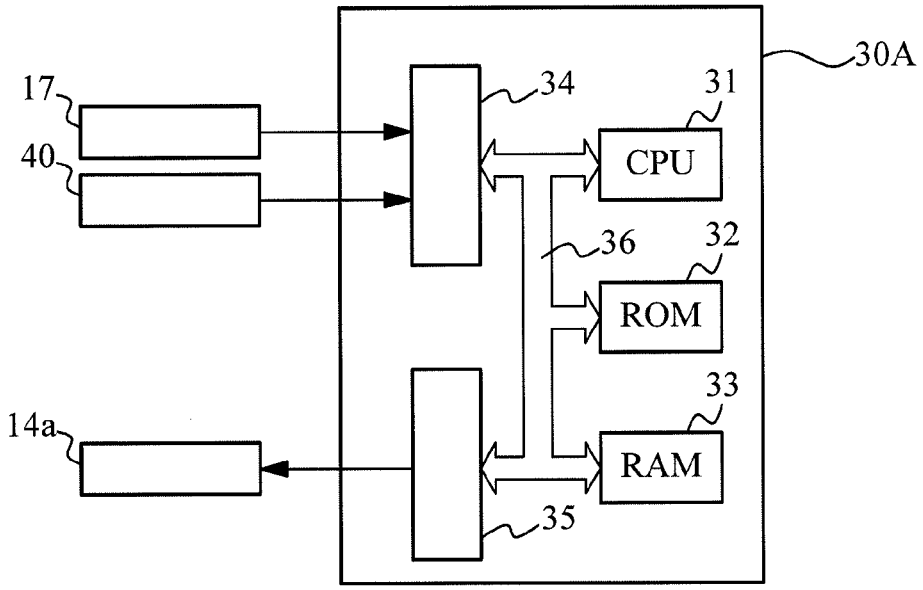
FIG. 6 is a schematic configuration diagram of an ECU.

FIG. 6 is a schematic configuration diagram of an ECU 30A. The ECU 30A includes a microcomputer including a CPU 31, a ROM 32, and a RAM 33, and input/output circuits 34, 35. These components are interconnected through a bus 36. The ECU 30A is electrically connected to the detecting unit 17 and a sensor group 40 to detect the operating condition of the engine 2 and the state of the vehicle through the input circuit 34. Moreover, it is electrically connected to the actuator 14*a* through the output circuit 35.

The sensor group 40 includes a sensor that enables the detection of the rotation speed NE of the engine 2, a sensor that enables the detection of the load of the engine 2, a sensor that detects temperature thw of the coolant flowing through the engine 2, a sensor that enables the detection of the vehicle speed, and a sensor that detects outside air temperature of the vehicle. The temperature thw is, for example, a temperature of the coolant in the third portion SG3. The sensor group 40 may be indirectly connected through a control device that controls the engine 2 for example. Or, the ECU 30A may be a control device that controls, for example, the engine 2.

The ROM 72 stores programs in which various processes executed by the CPU 31 are written and map data. The CPU 31 executes the process based on the programs stored in the ROM 32 while using a temporary storage area of the RAM 33 as necessary to achieve various types of functional portions in the ECU 30A. The ECU 30A functionally achieves the following control unit.

The control unit controls the valve portion V to switch the distribution control state of at least one of the valve mechanisms V1, V2 of the valve portion V when one of an open failure, which causes a thermostat to be kept open, and a close failure, which causes a thermostat to be kept closed, occurs in one of the thermostats 18, 19.

More specifically, when the close failure occurs in one thermostat of the thermostats 18, 19, the control unit controls the valve portion V to increase the flow volume of the coolant distributed through the other thermostat by controlling the valve portion V to switch the distribution control state of at least one of the valve mechanisms V1, V2 of the valve portion V.

The control unit controls the valve portion V to lift at least the restriction on the distribution of the coolant through the second divergent pathway PB2 when the close failure occurs in the first thermostat 18 while the valve portion V restricts the distribution of the coolant through the second divergent pathway PB2 and does not restrict the distribution of the coolant through the high-temperature side supply pathway PH. This increases the flow volume of the coolant distributed through the second thermostat 19 when the close failure occurs in the first thermostat 18. The valve portion V can control the distribution of the coolant through the high-temperature side supply pathway PH by the first valve mechanism V1. In addition, it can control the distribution of the coolant through the second divergent pathway PB2 by the second valve mechanism V2.

Specifically, the control unit controls the valve portion V to lift the restriction on the distribution of the coolant through the second divergent pathway PB2 when the close failure occurs in the first thermostat 18 while the valve portion V restricts the distribution of the coolant through the second divergent pathway PB2 and lift the restriction on the distribution of the coolant through the high-temperature side supply pathway PH.

This is because the first valve mechanism V1 is located in the third portion SG3 in cooling the engine 2 by not restricting the distribution of the coolant through the high-temperature side supply pathway PH. When the first valve mechanism V1 is not located in the high-temperature side supply pathway PH, for example, the valve portion V never restricts the distribution of the coolant through the high-temperature side supply pathway PH. Thus, in this case, the state that the valve portion V lifts the restriction on the distribution of the coolant through the high-temperature side supply pathway PH is never achieved.

On the other hand, when the valve portion V includes a valve mechanism in, for example, at least one of the portions SG1, SG3, the valve portion V needs to lift the restriction on the distribution of the coolant through the high-temperature side supply pathway PH in cooling the engine 2 by not restricting the distribution of the coolant through the high-temperature side supply pathway PH.

Therefore, when valve portion V includes a valve mechanism in the high-temperature side supply pathway PH, the state that the valve portion V restricts the distribution of the coolant through the second divergent pathway PB2 and does not restrict the distribution of the coolant through the high-temperature side supply pathway PH means a state that the valve portion V restricts the distribution of the coolant through the second divergent pathway PB2 and lifts the restriction on the distribution of the coolant through the high-temperature side supply pathway PH.

The control unit can activate the distribution control of the coolant by the first thermostat 18 by controlling the valve portion V to lift the restriction on the distribution of the coolant through the high-temperature side supply pathway PH. In addition, it can deactivate the distribution control of the coolant by the second thermostat 19 by controlling the valve portion V to restrict the distribution of the coolant through the second divergent pathway PB2. The control unit can activate the distribution control of the coolant by the second thermostat 19 by controlling the valve portion V to lift the restriction on the distribution of the coolant through the second divergent pathway PB2.

The control unit can perform high coolant-temperature control that regulates the temperature thw relatively high by activating the distribution control of the coolant by the first thermostat 18 and deactivating the distribution control of the coolant by the second thermostat 19. The high coolant-temperature control can regulate the temperature thw so that temperature thw becomes the predetermined value A (more accurately, temperature taking into account the effects of the coolant distributed through the first radiator bypass pathway P11 with respect to the predetermined value A) by opening and closing the first thermostat 18.

The control unit can perform low coolant-temperature control that regulates the temperature thw relatively low by activating the distribution control of the coolant by the second thermostat 19. The low coolant-temperature control can be performed even when the distribution control of the coolant by the first thermostat 18 is activated. This is because the first thermostat 18 closes when the temperature thw falls below the predetermined value A. The low coolant-temperature control can regulate the temperature thw so that the temperature thw becomes the predetermined value B (more accurately, temperature taking into account the effects of the coolant distributed through the first radiator bypass pathway P11 with respect to the predetermined value B) by opening and closing the second thermostat 19.

The control unit controls the valve portion V as described in the following when controlling the valve portion V to lift at least the restriction on the distribution of the coolant through the second divergent pathway PB2 when the close failure occurs in the first thermostat 18. That is to say, when the temperature thw exceeds a predetermined value C, the valve portion V is controlled so as to lift at least the restriction on the distribution of the coolant through the second divergent pathway PB2. The predetermined value C can be set to be greater than the predetermined value A. The predetermined value C can be a value changing in accordance with the vehicle speed, the outside air temperature, or the load of the engine 2.

When controlling the valve portion V to lift at least the restriction on the distribution of the coolant through the second divergent pathway PB2, the control unit specifically controls the valve portion V to lift the restriction on both the distribution of the coolant through the high-temperature side supply pathway PH and the second divergent pathway PB2. The reason thereof includes a fact that the first valve mechanism V1 is located in the third portion SG3 in cooling the engine 2. When the first valve mechanism V1 is not located in the high-temperature side supply pathway PH or is located in the first portion SG1 of the portions SG1, SG3, the valve portion V does not have to lift the restriction on the distribution of the coolant through the high-temperature side supply pathway PH.

The reason why the distribution of the coolant through the high-temperature side supply pathway PH is also mentioned is because the change of the phase of the rotary valve body 13 is necessary. When the valve portion V includes respective stand-alone valves (e.g. solenoid valves) in the portions SG2, SG3 of the portions SG1, SG2, SG3 as a valve mechanism, the valve portion V can keep, before and after the control, lifting the restriction on the distribution of the coolant through the high-temperature side supply pathway PH. That is to say, with respect to the distribution of the coolant through the high-temperature side supply pathway PH, the valve portion V may be not particularly controlled while the restriction on the distribution of the coolant through the high-temperature side supply pathway PH is kept lifted.

Therefore, depending on the arrangement and the structure of the valve mechanism of the valve portion V (e.g. the rotary valve body 13), controlling the valve portion V to lift at least the restriction on the distribution of the coolant through the second divergent pathway PB2 means controlling the valve portion V to lift both the restriction on the distribution of the coolant through the high-temperature side supply pathway PH and the restriction on the distribution of the coolant through the second divergent pathway PB2 in increasing the flow volume of the coolant distributed through the second thermostat 19.

The control unit controls the valve portion V to lift the restriction on the distribution of the coolant through the second divergent pathway PB2 when the temperature thw exceeds the predetermined value C, and controls the valve portion V to restrict at least the distribution of the coolant through the second divergent pathway PB2 when the temperature thw falls below a predetermined value D. More specifically, the control unit controls the valve portion V to lift the restriction on the distribution of the coolant through the high-temperature side supply pathway PH and restrict the distribution of the coolant through the second divergent pathway PB2. This is in consideration of the fact that the high coolant-temperature control is being performed. The predetermined value D may be set to a value less than the predetermined value A. It may be set to a value greater than the predetermined value B.

The present embodiment achieves the first fluid control system that is a fluid control system including the thermostat portion T, the valve portion V, and the ECU 30A.

A description will next be given of a first control operation that is a control operation of the first fluid control system with reference to a flowchart illustrated in FIG. 7. The ECU 30A determines whether the high coolant-temperature control is being performed (step S1). It can be determined whether the high coolant-temperature control is being performed by determining whether the rotary valve body 13 activates the distribution control of the coolant by the first thermostat 18 and deactivates the distribution control of the coolant by the second thermostat 19 based on the phase of the rotary valve body 13.

When the determination at step S1 is No, the ECU 30A maintains the distribution control state of the valve portion V (step S8). When the high coolant-temperature control is not being performed, the low coolant-temperature control may be performed. Thus, at step S8, the distribution control state of the valve portion V can be maintained to, for example, a state in which the low coolant-temperature control is performed. When the determination at step S1 is Yes, the ECU 30A calculates the predetermined value C (step S2). The predetermined value C can be calculated based on, for example, the vehicle speed, the outside air temperature, or the load of the engine 2.

Subsequent to step S2, the ECU 30A determines whether the temperature thw is greater than the predetermined value C (step S3). When the determination is Yes, the process goes to step S5, and the ECU 30A controls the valve portion V so that the distribution control of the coolant by the second thermostat 19 is activated (activate the second thermostat 19). More specifically, at step S5, the ECU 30A controls the valve portion V to lift both the restrictions on the distribution of the coolant through the high-temperature side supply pathway PH and the second divergent pathway PB2.

When the determination at step S3 is No, the ECU 30A determines whether the temperature thw falls below the predetermined value D (step S4). When the determination is No, the ECU 30A maintains the distribution control state of the valve portion V (step S6). On the other hand, when the determination at step S4 is Yes, the process moves to step S7, and the ECU 30A controls the valve portion V so that the distribution control of the coolant by the second thermostat 19 is deactivated (deactivate the second thermostat 19).

More specifically, at step S7, the ECU 30A controls the valve portion V to lift the restriction on the distribution of the coolant through the high-temperature side supply pathway PH and restrict the distribution of the coolant through the second divergent pathway PB2. Thus, in other words, the first thermostat 18 is activated at step S7. The process goes back to step S1 after steps S5, S6, S7 and S8.

A description will next be given of advantages of the first fluid control system. In the first fluid control system, the thermostat portion T includes the first thermostat 18 in the first divergent pathway PB1 and the second thermostat 19, of which the open valve temperature is set to be less than that of the first thermostat 18, in the second divergent pathway PB2. In addition, the valve portion V includes the second valve mechanism V2 in at least the second portion SG2 of the portions SG1, SG2, SG3.

Thus, the first fluid control system can activate or deactivate the distribution control of the coolant by the second thermostat 19. In addition, it switches between the activation and the deactivation of the distribution control of the coolant by the second thermostat 19 to enable the distribution control of the coolant by the second thermostat 19 to be performed when the distribution control of the coolant by the first thermostat 18 is activated while the distribution control of the coolant by the second thermostat 19 is activated. In addition, it can enable the distribution control of the coolant by the first thermostat 18 to be performed when the distribution control of the coolant by the first thermostat 18 is activated while the distribution control of the coolant by the second thermostat 19 is deactivated.

The first fluid control system controls the valve portion V to lift at least the restriction on the distribution of the coolant through the second divergent pathway PB2 when the close failure occurs in the first thermostat 18 while the valve portion V restricts the distribution of the coolant through the second divergent pathway PB2 and does not restrict the distribution of the coolant through the high-temperature side supply pathway PH. This increases the flow volume of the coolant distributed through the second thermostat 19. Thus, the first fluid control system can supply the coolant to the engine 2 through the second divergent pathway PB2 even when the close failure occurs in the first thermostat 18. As a result, the deterioration of the cooling state of the engine 2 due to the increase in the temperature thw can be prevented.

Specifically, the first fluid system controls the valve portion V to lift the restriction on the distribution of the coolant through the second divergent pathway PB2 when the temperature thw exceeds the predetermined value C. This control enables to control the valve portion V to lift the restriction on the distribution of the coolant through the second divergent pathway PB2 when the close failure occurs in the first thermostat 18.

Further, the first fluid control system controls the valve portion V to restrict the distribution of the coolant through the second divergent pathway PB2 when the temperature thw falls below the predetermined value D. This control enables to regulate the temperature thw between the predetermined values C and D in preventing the deterioration of the cooling state of the engine 2.

Figure 8A:
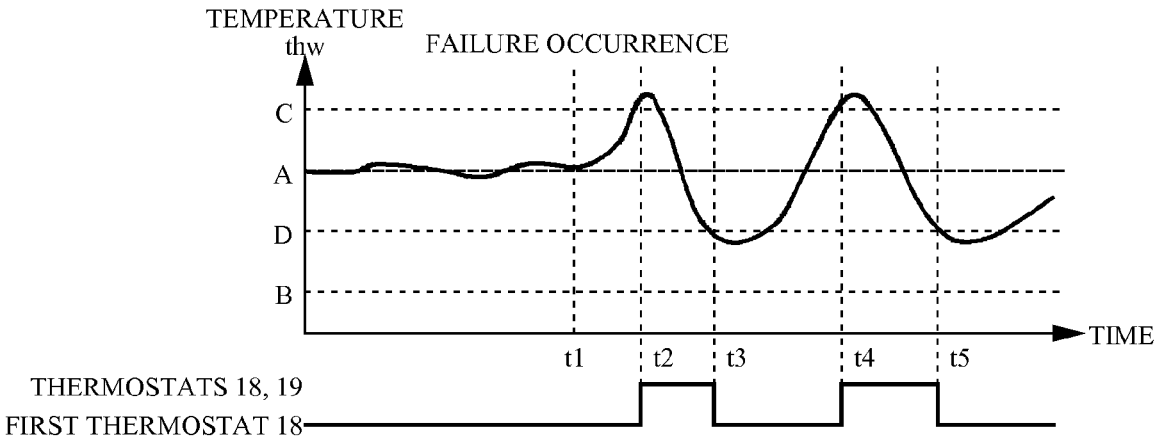
FIG. 8A is a diagram illustrating a change of temperature based on the first control operation when a close failure occurs in a first thermostat.
Figure 8B:
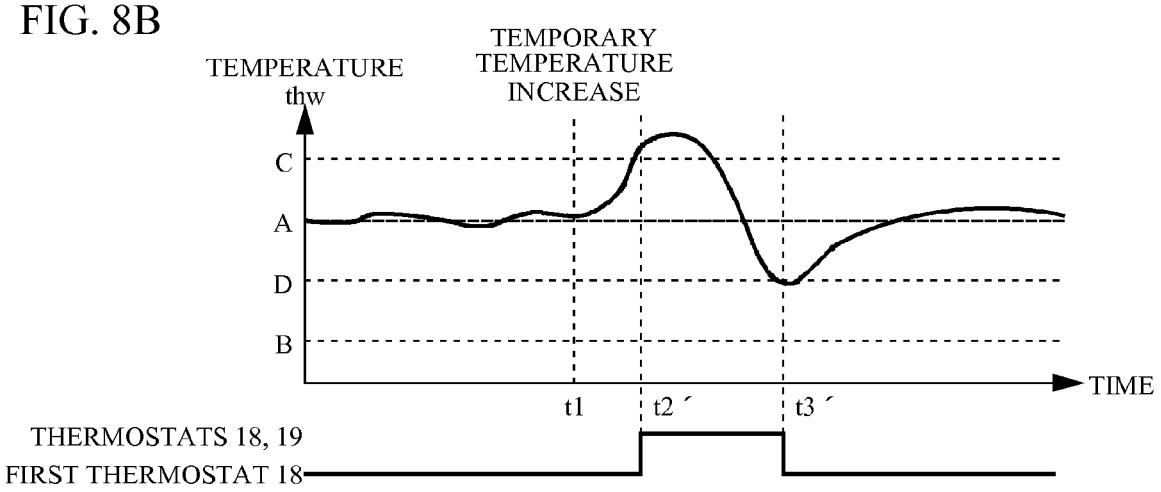
FIG. 8B is a diagram illustrating change of temperature based on the first control operation when first and second thermostats are normal.

FIG. 8A is a diagram illustrating a change of the temperature thw based on the first control operation when the close failure occurs in the first thermostat 18. FIG. 8B is a diagram illustrating a change of the temperature thw based on the first control operation when the thermostats 18, 19 are normal. In FIG. 8A and FIG. 8B, the vertical axis represents the temperature thw, and the horizontal axis represents time. FIG. 8A and FIG. 8B also present the thermostats 18, 19 of which the distribution control of the coolant is activated. FIG. 8A illustrates a case in which the close failure occurs in the first thermostat 18 at time t1. FIG. 8B illustrates a case in which the temperature thw temporarily increases at time t1.

As illustrated in FIG. 8A, the temperature thw is regulated to the predetermined value A by the high coolant-temperature control till time t1. On the other hand, when the close failure occurs in the first thermostat 18 at time t1, the coolant through the radiator 6 stops being supplied to the engine 2. As a result, the temperature thw starts increasing after time t1, and exceeds the predetermined value C at time t2.

When the temperature thw exceeds the predetermined value C, the valve portion V is controlled so as to lift the restriction on the distribution of the coolant through the second divergent pathway PB2. Thus, the coolant is supplied to the engine 2 through the second divergent pathway PB2. As a result, the temperature thw starts decreasing after time t2, and falls below the predetermined value D at time t3. When the temperature thw falls below the predetermined value D, the valve portion V is controlled so as to restrict the distribution of the coolant through the second divergent pathway PB2. Thus, the coolant stops being supplied to the engine 2 through the second divergent pathway PB2. As a result, the temperature thw starts increasing after time t3. The temperature thw is regulated at time t4, t5 as regulated at time t2, t3.

As illustrated in FIG. 8B, the first fluid control system can regulate the temperature thw as described in the following when the thermostats 18, 19 are normal. That is to say, when the temperature thw temporarily increases by a certain cause at time t1 and the temperature thw then exceeds the predetermined value C at time t2', for example, the coolant can be supplied to the engine 2 through the divergent pathways PB1, PB2 by controlling the valve portion V to lift the restriction on the distribution of the coolant through the second divergent pathway PB2. This control enables to decrease the temperature thw after time t2'.

In addition, when the temperature thw falls below the predetermined value D at time t3' after time t2', the coolant can be supplied to the engine 2 through the first divergent pathway PB1 of the divergent pathways PB1, PB2 by controlling the valve portion V to restrict the distribution of the coolant through the second divergent pathway PB2. That is to say, the coolant can be supplied to the engine 2 through the high-temperature side supply pathway PH. As a result, the temperature thw can be increased after time t3'. In addition, this enables to resume the high coolant-temperature control when the cause that temporarily increased the temperature thw already disappears.

Even when the temperature thw temporarily exceeds the predetermined value C by a certain cause, the first fluid control system can resume the high coolant-temperature control when the cause disappears by controlling the valve portion V to lift the restriction on the distribution of the coolant through the high-temperature side supply pathway PH and restrict the distribution of the coolant through the second divergent pathway PB2 when the temperature thw falls below the predetermined value D. This enables to handle the close failure of the first thermostat 18 by preparing for the close failure of the first thermostat 18 from when the thermostats 18, 19 are normal. That is to say, this enables to eliminate the need for the detection of the close failure of the first thermostat 18.

The first fluid control system may be configured not to particularly control the valve portion V when the thermostats 18, 19 are normal during the high coolant-temperature control. To achieve this configuration, the predetermined value C may be set within a range that the temperature thw never exceeds when the thermostats 18, 19 are normal during the high coolant-temperature control.

The first fluid control system can change the predetermined value C in accordance with a predetermined condition that changes the temperature thw during the high coolant-temperature control (e.g. the vehicle speed, the outside air temperature, or the load of the engine 2). This enables to avoid setting the predetermined value C to be a large value to fit the stringent conditions. As a result, even when the failure occurs in the first thermostat 18, the deterioration of the cooling state of the engine 2 can be appropriately prevented. In this case, the predetermined value C may increase as the vehicle speed, the outside air temperature, or the load of the engine 2 increases.

In the first fluid control system, the valve portion V have valve mechanisms in two portions, including the second portion SG2, out of the portions SG1, SG2, SG3. That is to say, the first fluid control system enables the distribution control by the thermostats 18, 19 to be performed by activating or deactivating the distribution control of the coolant by the second thermostat 19 while activating the distribution control of the coolant by the first thermostat 18 under the above described configuration. In addition, when valve mechanisms are located in the portions SG2, SG3, the supply of the coolant to the engine 2 can be restricted by restricting the distribution of the coolant through the high-temperature side supply pathway PH.

In the first fluid control system, the valve portion V includes the single-axis rotary valve body 13 located in the portions SG2, SG3, and thus has respective valve mechanisms in two portions, including the second portion SG2, out of the portions SG1, SG2, SG3. Therefore, the first fluid control system can control the valve portion V by the single actuator 14*a*. As a result, the structure has an advantage in cost.

In the first fluid control system, the rotary valve body 13 is located in the portions SG2, SG3 out of the portions SG1, SG2, SG3. Thus, the first fluid control system can construct the rotary valve 10 capable of simultaneously controlling the distribution of the coolant at the inlet side and the outlet side of the W/P 1. That is to say, the rotary valve 10 capable of directly being located with respect to the W/P 1 can be constructed. As a result, the cooling circuit 100 can be appropriately simplified and downsized by the integration of circuit components.

Second Embodiment

A second fluid control system of the present embodiment is practically the same as the first fluid control system except that it includes an ECU 30B instead of the ECU 30A. The ECU 30B is practically the same as the ECU 30A except that the control unit is further implemented as described in the following when controlling the valve portion V to increase the flow volume of the coolant distributed through one of the thermostats 18, 19 when the close failure occurs in the other of them. Thus, the illustration of the ECU 30B is omitted. When controlling the valve portion V as just described, the control unit may perform the following control without performing the control described in the first embodiment.

In the ECU 30B, the control unit controls the valve portion V to restrict at least the distribution of the coolant through the second divergent pathway PB2 when the close failure occurs in the second thermostat 19 while the valve portion V lifts the restriction on the distribution of the coolant through the low-temperature side supply path PL by lifting at least the restriction on the distribution of the coolant through the second divergent pathway PB2. This control increases the flow volume of the coolant distributed through the first thermostat 18 when the close failure occurs in the second thermostat 19.

Specifically, the control unit controls the valve portion V to restrict at least the distribution of the coolant through the second divergent pathway PB2 when the close failure occurs in the second thermostat 19 while the valve portion V lifts the restriction on the distribution of the coolant through the high-temperature side supply pathway PH and lifts the restriction on the distribution of the coolant through the second divergent pathway PB2.

This is because the first valve mechanism V1 is located in the third portion SG3 in cooling the engine 2 by lifting the restriction on the distribution of the coolant through the low-temperature side supply path PL. When the first valve mechanism V1 is not located in, for example, the high-temperature side supply pathway PH, the valve portion V never restricts the distribution of the coolant in the third portion SG3. In addition, when the valve portion V has a valve mechanism in the first portion SG1 of the portions SG1, SG3 for example, the coolant can be supplied to the engine 2 through the low-temperature side supply path PL without particularly lifting the restriction on the distribution of the coolant through the high-temperature side supply pathway PH.

Thus, when the valve portion V has a valve mechanism in the third portion SG3, the state that the restriction on the distribution of the coolant through the low-temperature side supply path PL is lifted by lifting at least the restriction on the distribution of the coolant through the second divergent pathway PB2 means a state that the restriction on the distribution of the coolant is lifted in the third portion SG3 and the distribution of the coolant through the second divergent pathway PB2 is lifted.

The control unit controls the valve portion V as described in the following in controlling the valve portion V as described above when the close failure occurs in the second thermostat 19. That is to say, when the temperature thw exceeds a predetermined value E, the valve portion V is controlled as described above. The predetermined value E may be set to a value greater than the predetermined value A. Further, the predetermined value E may be a value changing in accordance with the vehicle speed, the outside air temperature, or the load of the engine 2. The predetermined value E may be the same as the predetermined value C.

More specifically, when controlling the valve portion V to restrict at least the distribution of the coolant through the second divergent pathway PB2, the control unit controls the valve portion V to lift the restriction on the distribution of the coolant through the high-temperature side supply pathway PH and restrict the distribution of the coolant through the second divergent pathway PB2.

This reason includes the fact that the first valve mechanism V1 is located in the high-temperature side supply pathway PH in cooling the engine 2. When the first valve mechanism V1 is not located in, for example, the high-temperature side supply pathway PH, the valve portion V never controls the distribution of the coolant through the high-temperature side supply pathway PH. On the other hand, when the first valve mechanism V1 is located in, for example, the first portion SG1 out of the portions SG1, SG3, and the distribution of the coolant through the high-temperature side supply pathway PH is restricted, the valve portion V needs to be controlled so as to lift the restriction on the distribution of the coolant through the high-temperature side supply pathway PH and restrict the distribution of the coolant through the second divergent pathway PB2.

The reason why the distribution of the coolant through the high-temperature side supply pathway PH is also mentioned is because the phase change of the rotary valve body 13 is necessary. When the valve portion V includes respective stand-alone valves in the portions SG2, SG3 out of the portions SG1, SG2, SG3 as a valve mechanism, the valve portion V may keep, before and after the control, lifting the restriction on the distribution of the coolant through the high-temperature side supply pathway PH. That is to say, with respect to the distribution of the coolant through the high-temperature side supply pathway PH, the valve portion V may be not particularly controlled while lifting the restriction on the distribution of the coolant through, for example, the high-temperature side supply pathway PH.

Therefore, depending on the arrangement, the distribution control state, or the structure of the valve mechanism of the valve portion V, controlling the valve portion V to restrict at least the distribution of the coolant through the second divergent pathway PB2 means controlling the valve portion V to lift the restriction on the distribution of the coolant through the high-temperature side supply pathway PH and restrict the distribution of the coolant through the second divergent pathway PB2.

The control unit controls the valve portion V as described above when the temperature thw exceeds the predetermined value E, and controls the valve portion V to lift at least the restriction on the distribution of the coolant through the second divergent pathway PB2 when predetermined time a passes after the valve portion V was controlled as described above. More specifically, the control unit controls the valve portion V to lift both the restriction on the distribution of the coolant through the high-temperature side supply pathway PH and the restriction on the distribution of the coolant through the second divergent pathway PB2. This is in consideration of the fact that the low coolant-temperature control is being performed.

Figure 9:
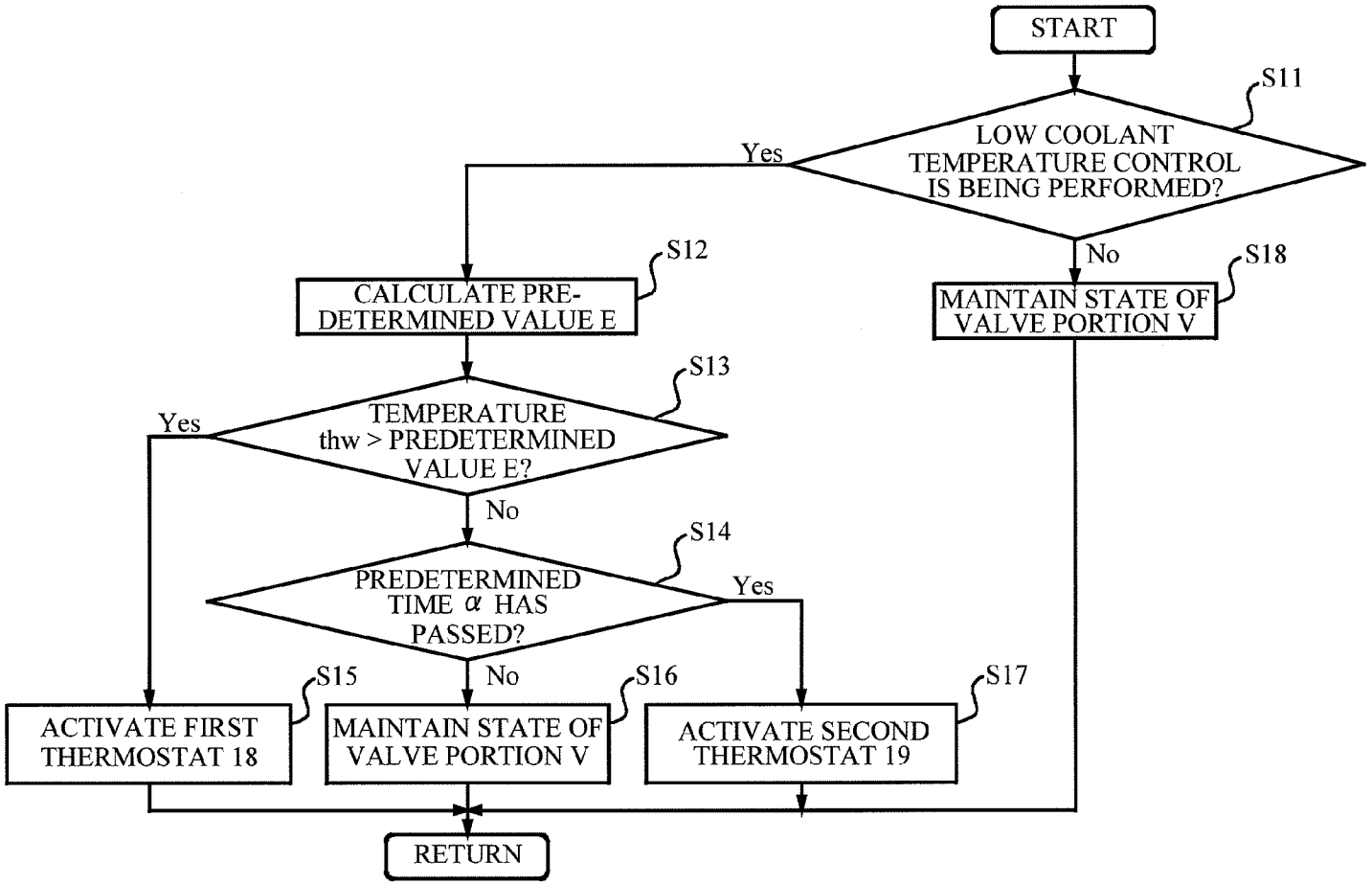
FIG. 9 is a flowchart illustrating a second control operation.

A description will next be given of a second control operation that is a control operation of the second fluid control system with reference to a flowchart illustrated in FIG. 9. The ECU 30B determines whether the low coolant-temperature control is being performed (step S11). It is determined whether the low coolant-temperature control is being performed by determining whether the rotary valve body 13 activates the distribution control of the coolant by the first thermostat 18 and activates the distribution control of the coolant by the second thermostat 19 based on the phase of the rotary valve body 13 for example.

When the determination at step S11 is No, the ECU 30B maintains the distribution control state of the valve portion V (step S18). When the low coolant-temperature control is not being performed, the high coolant-temperature control may be performed. Thus, at step S18, the distribution control state of the valve portion V can be maintained to, for example, a state in which the high coolant-temperature control is performed. When the determination at step S11 is Yes, the ECU 30B calculates the predetermined value E (step S12). The predetermined value E can be calculated based on, for example, the vehicle speed, the outside air temperature, or the load of the engine 2.

Subsequent to step S12, the ECU 30B determines whether the temperature thw is greater than the predetermined value E (step S13). When the determination is Yes, the process goes to step S15, and the ECU 30B controls the valve portion V so that the distribution control of the coolant by the first thermostat 18 is activated (activate the first thermostat 18). Specifically, at step S15, the ECU 30B controls the valve portion V to lift the restriction on the distribution of the coolant through the high-temperature side supply pathway PH and restrict the distribution of the coolant through the second divergent pathway PB2.

When the determination at step S13 is No, the ECU 30B determines whether predetermined time α has passed (step S14). The ECU 30B can start measuring the time when the determination at step S13 becomes Yes in the routine immediately after the determination at step S13 was No. When the determination at step S14 is No, the ECU 30B maintains the distribution control state of the valve portion V (step S16).

When the determination at step S14 is Yes, the process goes to step S17, and the ECU 30B controls the valve portion V so that the distribution control of the coolant by the second thermostat 19 is activated (activate the second thermostat 19). Specifically, at step S17, the ECU 30B controls the valve portion V to lift both the restriction on the distribution of the coolant through the high-temperature side supply pathway PH and the restriction on the distribution of the coolant through the second divergent pathway PB2. The process goes back to step S11 after steps S15, S16, S17, and S18.

A description will next be given of advantages of the second fluid control system. The second fluid control system controls the valve portion V to restrict at least the distribution of the coolant through the second divergent pathway PB2 when the close failure occurs in the second thermostat 19 while the valve portion V lifts the restriction on the distribution of the coolant through the low-temperature side supply path PL by lifting at least the restriction on the distribution of the coolant through the second divergent pathway PB2. This increases the flow volume of the coolant distributed through the first thermostat 18 when the close failure occurs in the second thermostat 19.

The second fluid control system can restrict the distribution of the coolant through the second radiator bypass pathway P12 by controlling the valve portion V to restrict the distribution of the coolant through the second divergent pathway PB2. This enables to increase the flow volume of the coolant distributed through the high-temperature side supply pathway PH to secure it. Thus, the second fluid control system can supply the coolant to the engine 2 through the high-temperature side supply pathway PH even when the close failure occurs in the second thermostat 19. As a result, the deterioration of the cooling state of the engine 2 due to the increase in the temperature thw can be prevented.

Specifically, the second fluid control system can control the valve portion V as described above when the close failure occurs in the second thermostat 19 by controlling the valve portion V as described above when the temperature thw exceeds the predetermined value E.

Further, the second fluid control system controls the valve portion V to lift at least the restriction on the distribution of the coolant through the second divergent pathway PB2 when predetermined time a has passed after the valve portion V was controlled as described above when the predetermined value E was exceeded. This can prevent the engine 2 from, for example, overheating even though the temperature thw is regulated relatively high in preventing the deterioration of the cooling state of the engine 2.

Figure 10A:
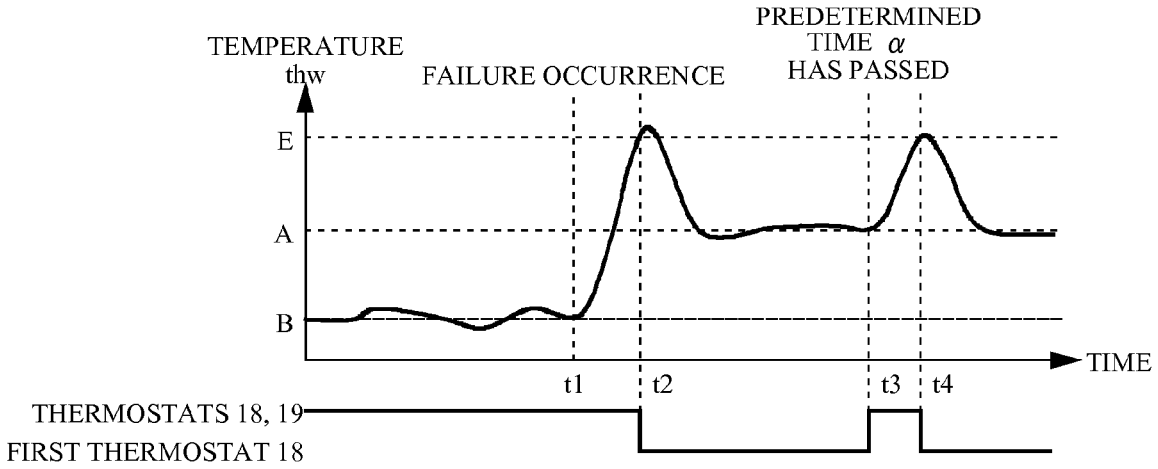
FIG. 10A is a diagram illustrating a change of temperature based on the second control operation when the close failure occurs in the second thermostat.
Figure 10B:
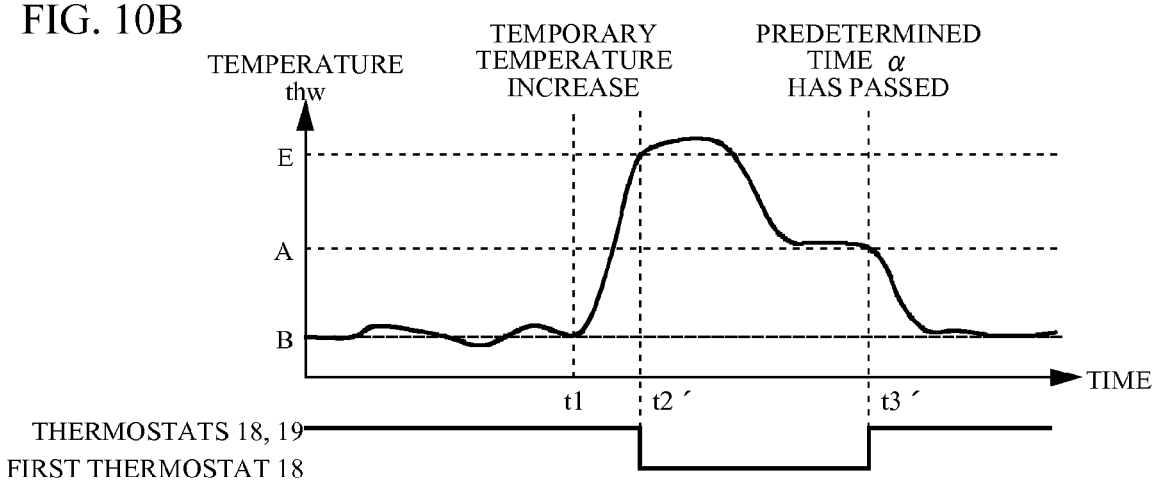
FIG. 10B is a diagram illustrating a change of temperature based on the second control operation when the first and second thermostats are normal.

FIG. 10A is a diagram illustrating a change of the temperature thw based on the second control operation when the close failure occurs in the second thermostat 19. FIG. 10B is a diagram illustrating a change of the temperature thw based on the second control operation when the thermostats 18, 19 are normal. In FIG. 10A and FIG. 10B, the vertical axis represents the temperature thw, and the horizontal axis represents time. FIG. 10A and FIG. 10B also illustrates the thermostats 18, 19 of which the distribution control of the coolant is activated. FIG. 10A illustrates a case in which the close failure occurs in the second thermostat 19 at time t1. FIG. 10B illustrates a case in which the temperature thw temporarily increases at time t1.

As illustrated in FIG. 10A, the temperature thw is regulated to the predetermined value B by the low coolant-temperature control till time t1. On the other hand, when the close failure occurs in the second thermostat 19 at time t1, the coolant stops being supplied to the engine 2 through the radiator 6. In addition, the coolant starts being supplied to the engine 2 through the second radiator bypass pathway P12. As a result, the temperature thw starts increasing after time t1, and exceeds the predetermined value E at time t2.

When the temperature thw exceeds the predetermined value E, the valve portion V is controlled so as to restrict the distribution of the coolant through the second divergent pathway PB2. Thus, the coolant stops being supplied to the engine 2 through the second radiator bypass pathway P12. In addition, when the temperature thw exceeds the predetermined value E, the valve portion V is controlled so as to lift the restriction on the distribution of the coolant through the high-temperature side supply pathway PH. Thus, the coolant starts being supplied to the engine 2 through the high-temperature side supply pathway PH. As a result, the temperature thw starts decreasing after time t2, and is regulated to the predetermined value A by the first thermostat 18.

At time t3, predetermined time a has passed from time t2. When predetermined time α has passed from time t2, the valve portion V is controlled so as to lift the restriction on the distribution of the coolant through the second divergent pathway PB2. Thus, the coolant starts being supplied to the engine 2 through the second radiator bypass pathway P12 at time t3. As a result, the temperature thw starts increasing after time t3. At time t4, the temperature thw is regulated as at time t2.

As illustrated in FIG. 10B, the second fluid control system can regulate the temperature thw as described in the following when the thermostats 18, 19 are normal. That is to say, when the temperature thw temporarily increases by a certain cause at time t1 and the temperature thw then exceeds the predetermined value E at time t2' for example, the supply of the coolant to the engine 2 through the second radiator bypass pathway P12 can be restricted while the coolant is supplied to the engine 2 through the high-temperature side supply pathway PH by controlling the valve portion V to lift the restriction on the distribution of the coolant through the high-temperature side supply pathway PH and to restrict the distribution of the coolant through the second divergent pathway PB2. This enables to decrease the temperature thw after time t2'.

In addition, when predetermined time a has passed at time t3' after time t2', the coolant can be supplied to the engine 2 through the divergent pathways PB1, PB2 in a state in which the temperature thw is greater than the predetermined value A by controlling the valve portion V to lift the restriction on the distribution of the coolant through the second divergent pathway PB2. As a result, the temperature thw can be further decreased after time t3'. This enables to resume the low coolant-temperature control when the cause that temporarily increased the temperature thw has already been disappeared.

Even when the temperature thw temporarily exceeds the predetermined value E by a certain cause, the second fluid control system can resume the low coolant-temperature control when the cause disappears by controlling the valve portion V to lift both the restriction on the distribution of the coolant through the high-temperature side supply pathway PH and the restriction on the distribution of the coolant through the second divergent pathway PB2 when predetermined time a has passed. This enables to handle the close failure of the second thermostat 19 by preparing for the close failure of the second thermostat 19 from when the thermostats 18, 19 are normal. That is to say, this enables to eliminate the need for the detection of the close failure of the second thermostat 19.

The second fluid control system may be configured not to particularly control the valve portion V when the thermostats 18, 19 are normal during the low coolant-temperature control. To achieve this configuration, the predetermined value E may be set within a range that the temperature thw never exceeds when the thermostats 18, 19 are normal during the low coolant-temperature control. In this case, the predetermined value E is preferably configured to be variable in accordance with a predetermined condition that changes the temperature thw during the low coolant-temperature control (e.g. the vehicle speed, the outside air temperature, and the load of the engine 2).

The second fluid control system can prevent the deterioration of the cooling state of the engine 2 due to the increase in the temperature even when the close failure occurs in the first thermostat 18 or the close failure occurs in the second thermostat 19.

Third Embodiment

A third fluid control system in accordance with the present embodiment is practically the same as the second fluid control system except that it includes an ECU 30C instead of the ECU 30B. The ECU 30C is practically the same as the ECU 30B except that the control unit is implemented so as to further perform the following control. Thus, the illustration of the ECU 30C is omitted. The control unit can perform the following control without performing one of the control described in the first and second embodiments (control that controls the valve portion V to increase the flow volume of the coolant distributed through one of the thermostats 18, 19 when the close failure occurs in the other of them).

In the ECU 30C, the control unit further controls the valve portion V to decrease the flow volume of the coolant distributed through the third portion SG3 by controlling the valve portion V to switch the distribution control state of at least one of the valve mechanisms V1, V2 of the valve portion V when the open failure occurs in one of the thermostats 18, 19.

The control unit controls the valve portion V to restrict at least the distribution of the coolant through the high-temperature side supply pathway PH when the open failure occurs in the first thermostat 18 while the valve portion V lifts the restriction on the distribution of the coolant through the high-temperature side supply pathway PH and restricts the distribution of the coolant through the second divergent pathway PB2. This decreases the flow volume of the coolant distributed through the third portion SG3 when the open failure occurs in the first thermostat 18.

Specifically, the control unit controls the valve portion V to restrict both the distribution of the coolant through the high-temperature side supply pathway PH and the distribution of the coolant through the second divergent pathway PB2. The control unit may control the valve portion V to restrict the distribution of the coolant through the high-temperature side supply pathway PH and lift the restriction on the distribution of the coolant through the second divergent pathway PB2.

This is because the first valve mechanism V1 is located in the third portion SG3 in decreasing the flow volume in the third portion SG3. When the valve portion V includes a valve mechanism in, for example, the first portion SG1 out of the portions SG1, SG3, the valve portion V is controlled so as to restrict both the distribution of the coolant through the high-temperature side supply pathway PH and the distribution of the coolant through the second divergent pathway PB2 in decreasing the flow volume of the coolant in the third portion SG3.

When the valve portion V has respective stand-alone valves in, for example, the portions SG2, SG3 out of the portions SG1, SG2, SG3 as a valve mechanism, the valve portion V may keep, before and after the control, restricting the distribution of the coolant through the second divergent pathway PB2. That is to say, with respect to the distribution of the coolant through the second divergent pathway PB2, the valve portion V may be not particularly controlled while restricting the distribution of the coolant through the second divergent pathway PB2.

Therefore, depending on the arrangement or the structure of the valve mechanism of the valve portion V, controlling the valve portion V to restrict at least the distribution of the coolant through the high-temperature side supply pathway PH means controlling the valve portion V to restrict both the distribution of the coolant through the high-temperature side supply pathway PH and the distribution of the coolant through the second divergent pathway PB2 in decreasing the flow volume of the coolant in the third portion SG3.

The control unit controls the valve portion V as described above when the temperature thw falls below a predetermined value F in controlling the valve portion V as described above when the open failure occurs in the first thermostat 18. The predetermined value F may be set to a value less than the predetermined value A. The predetermined value F may be a value changing in accordance with the vehicle speed, the outside air temperature, or the load of the engine 2.

The control unit controls the valve portion V as described above when the temperature thw falls below the predetermined value F, and controls the valve portion V to lift at least the restriction on the distribution of the coolant through the high-temperature side supply pathway PH when the temperature thw exceeds a predetermined value G. In addition, it controls the valve portion V to lift at least the restriction on the distribution of the coolant through the high-temperature side supply pathway PH when predetermined time β has passed after the valve portion V was controlled as described above when the temperature thw fell below the predetermined value F. The predetermined value G may be set to a value greater than the predetermined value A.

In this case, the control unit specifically controls the valve portion V to lift the restriction on the distribution of the coolant through the high-temperature side supply pathway PH and restrict the distribution of the coolant through the second divergent pathway PB2. This is in consideration of the fact that the high coolant-temperature control being performed. The control unit may control the valve portion V as described above in at least when the temperature thw exceeds the predetermined value G or when predetermined time β has passed.

The valve portion V includes the first valve mechanism V1 in the third portion SG3 and the second valve mechanism V2 in the second portion SG2, and thus is configured to include valve mechanisms in two or more portions, including at least the second portion SG2, out of the portions SG1, SG2, SG3.

A description will next be given of a third control operation that is a control operation of the third fluid control system with reference to a flowchart illustrated in FIG. 11. The ECU 30C determines whether the high coolant-temperature control is being performed (step S21). When the determination at step S21 is No, the ECU 30C maintains the distribution control state of the valve portion V (step S29). At step S29, the distribution control state of the valve portion V can be maintained to a state in which the low coolant-temperature control is performed. When the determination at step S21 is Yes, the ECU 30C calculates the predetermined value F (step S22). The predetermined value F can be calculated based on, for example, the vehicle speed, the outside air temperature, or the load of the engine 2.

Subsequent to step S22, the ECU 30C determines whether the temperature thw is less than the predetermined value F (step S23). When the determination is Yes, the ECU 30C controls the valve portion V to put the restriction including forbiddance of the supply of the coolant to the engine 2 (step S26). Specifically, at step S26, the ECU 30C controls the valve portion V to restrict both the distribution of the coolant through the high-temperature side supply pathway PH and the distribution of the coolant through the second divergent pathway PB2.

When the determination at step S23 is No, the ECU 30C determines whether the temperature thw is greater than the predetermined value G (step S24). When the determination is No, the ECU 30C determines whether predetermined time β has passed (step S25). The ECU 30C can start measuring the time when the determination at step S23 becomes Yes in the routine immediately after the determination at step S23 was No. When the determination at step S25 is No, the ECU 30C maintains the distribution control state of the valve portion V (step S27).

On the other hand, when the determination at step S27 is No, the ECU 30C controls the valve portion V to lift the restriction on the supply, including permission of the supply of the coolant to the engine 2 (step S28). Specifically, at step S28, the ECU 30C controls the valve portion V to lift the restriction on the distribution of the coolant through the high-temperature side supply pathway PH and restrict the distribution of the coolant through the second divergent pathway PB2. The process goes back to step S21 after steps S26, S27, S28, and S29.

A description will next be given of advantages of the third fluid control system. The third fluid control system controls the valve portion V to restrict at least the distribution of the coolant through the high-temperature side supply pathway PH when the open failure occurs in the first thermostat 18 while the valve portion V lifts the restriction on the distribution of the coolant through the high-temperature side supply pathway PH and restricts the distribution of the coolant through the second divergent pathway PB2. This decreases the flow volume of the coolant distributed through the third portion SG3 when the open failure occurs in the first thermostat 18.

Thus, the third fluid control system can restrict the supply of the coolant to the engine 2 even when the open failure occurs in the first thermostat 18. As a result, the deterioration of the cooling state of the engine 2 due to the decrease in the temperature thw can be prevented.

The third fluid control system controls the valve portion V as described above when the temperature thw falls below the predetermined value F. This enables to control the valve portion V as described above when the open failure occurs in the first thermostat 18. Further, the third fluid control system controls the valve portion V to lift the restriction on the distribution of the coolant through the high-temperature side supply pathway PH when the temperature thw exceeds the predetermined value G. This enables to regulate the temperature thw between the predetermined values F and G in preventing the deterioration of the cooling state of the engine 2.

The third fluid control system controls the valve portion V to lift the restriction on the distribution of the coolant through the high-temperature side supply pathway PH when predetermined time β has passed after the valve portion V was controlled as described above when the temperature thw fell below the predetermined value F. This enables to regulate the temperature thw to prevent the excessive temperature increase of the coolant in the engine 2 when the temperature thw cannot be measured properly for example. The case in which the temperature thw cannot be measured properly is, for example, a case in which the temperature thw is measured at a portion located more downstream than the first valve mechanism V1 in the fluid supply pathway PS.

Figure 12A:
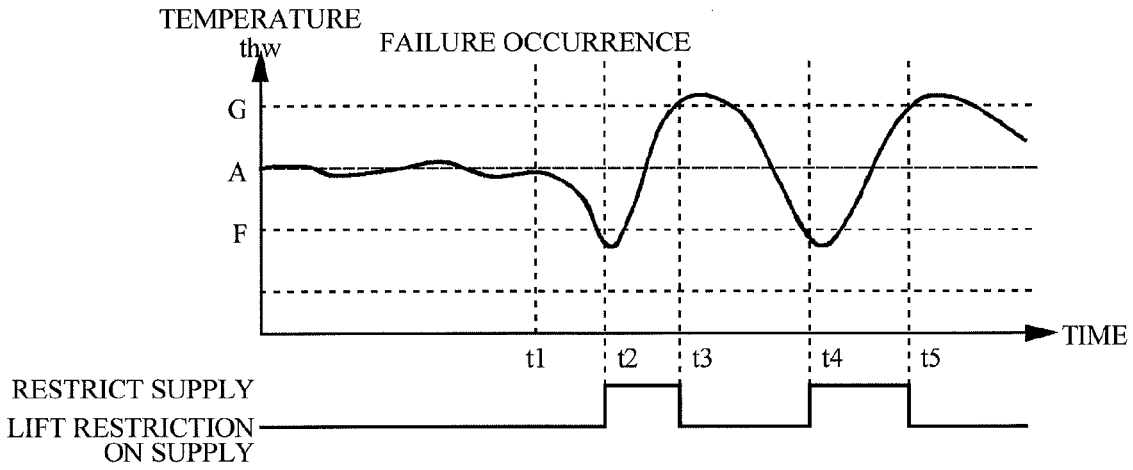
FIG. 12A is a diagram illustrating a change of temperature based on the third control operation when an open failure occurs in the first thermostat and illustrating a case in which a valve portion is controlled when the temperature exceeds a predetermined value.
Figure 12B:
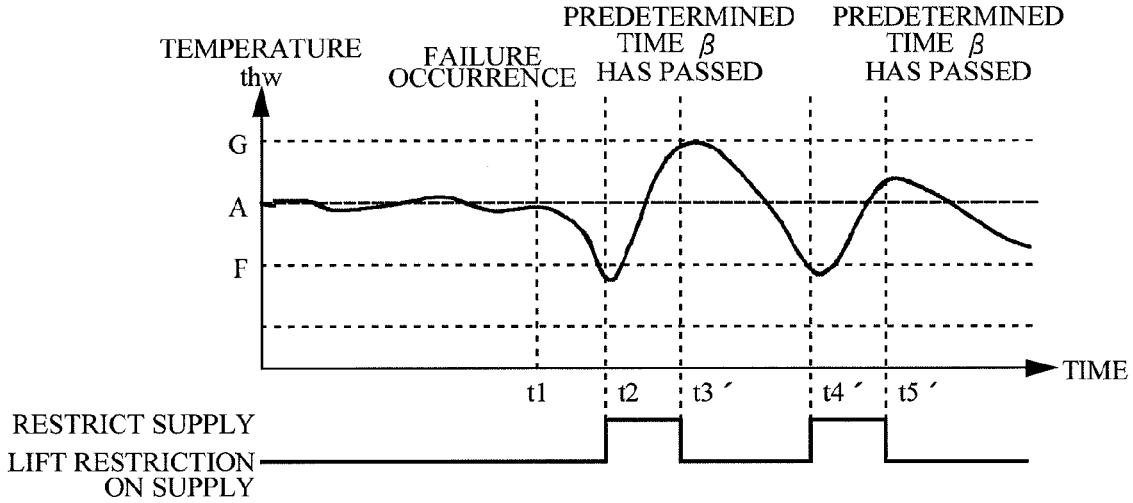
FIG. 12B is a diagram illustrating a change of temperature based on the third control operation when the open failure occurs in the first thermostat and illustrating a case in which the valve portion is controlled when a predetermined time has passed.

FIG. 12A and FIG. 12B are diagrams illustrating the change of the temperature thw based on the third control operation when the open failure occurs in the first thermostat 18. FIG. 12A illustrates a case in which the valve portion V is controlled when the temperature thw exceeds the predetermined value G. FIG. 12B illustrates a case in which the valve portion V is controlled when predetermined time β has passed. In FIG. 12A and FIG. 12B, the vertical axis represents the temperature thw, and the horizontal axis represents time. FIG. 12A and FIG. 12B also present whether the valve portion V restricts the supply of the coolant to the engine 2. Both FIG. 12A and FIG. 12B illustrate a case in which the open failure occurs in the first thermostat 18 at time t1.

As the cases illustrated in FIG. 12A and FIG. 12B, the temperature thw is regulated to the predetermined value A by the high coolant-temperature control till time t1. On the other hand, when the open failure occurs in the first thermostat 18 at time t1, the supply of the coolant to the engine 2 stops being restricted by the first thermostat 18. As a result, the temperature thw starts decreasing after time t1, and falls below the predetermined value F at time t2. When the temperature thw falls below the predetermined value F, the valve portion V is controlled so as to restrict the distribution of the coolant through the high-temperature side supply pathway PH. Thus, the supply of the coolant to the engine 2 is restricted. As a result, the temperature thw starts increasing after time t2.

In the case illustrated in FIG. 12A, the temperature thw exceeds the predetermined value G at time t3. When the temperature thw exceeds the predetermined value G, the valve portion V is controlled so as to lift the restriction on the distribution of the coolant through the high-temperature side supply pathway PH. Thus, the coolant starts being supplied to the engine 2. As a result, the temperature thw starts decreasing after time t3. At time t4, t5, the temperature thw is regulated as at time t2, t3.

In the case illustrated in FIG. 12B, predetermined time β has passed at time t3'. When predetermined time β has passed, the valve portion V is controlled so as to lift the restriction on the distribution of the coolant through the high-temperature side supply pathway PH. Thus, the coolant starts being supplied to the engine 2. As a result, the temperature thw starts decreasing after time t3'. At time t4', t5', the temperature thw is regulated as at time t2, t3'.

The third fluid control system specifically controls the valve portion V to lift the restriction on the distribution of the coolant through the high-temperature side supply pathway PH and restrict the distribution of the coolant through the second divergent pathway PB2 when the temperature thw exceeds the predetermined value G or when predetermined time β has passed.

Thus, even when the temperature thw temporarily falls below the predetermined value F by a certain cause, the third fluid control system can resume the high coolant-temperature control when the cause disappears. This enables to handle the open failure of the first thermostat 18 by preparing for the open failure of the first thermostat 18 from when the thermostats 18, 19 are normal. That is to say, this enables to eliminate the need for the detection of the open failure of the first thermostat 18.

The third fluid control system may be configured not to particularly control the valve portion V when thermostats 18, 19 are normal during the high coolant-temperature control. To achieve the above configuration, the predetermined value F may be set within a range that the temperature thw never falls below when the thermostats 18, 19 are normal during the high coolant-temperature control. In this case, the predetermined value F is preferably configured to be variable in accordance with a predetermined condition that changes the temperature thw during the high coolant-temperature control (e.g. the vehicle speed, the outside air temperature, or the load of the engine 2).

Fourth Embodiment

A fourth fluid control system of the present embodiment is practically the same as the third fluid control system except that it includes an ECU 30D instead of the ECU 30C. The ECU 30D is practically the same as the ECU 30C except that the control unit is further implemented as described in the following in controlling the valve portion V to decrease the flow volume of the coolant distributed through the third portion SG3 when the open failure occurs in one of the thermostats 18, 19. Thus, the illustration of the ECU 30D is omitted.

When controlling the valve portion V as just described, the control unit may perform control described in the following without performing the control described in the third embodiment. In addition, the control unit can perform the control described in the following without performing at least one of the control described in the first and second embodiments (the control that controls the valve portion V to increase the flow volume of the coolant distributed through one of the thermostats 18, 19 when the close failure occurs in the other of them).

In the ECU 30D, the control unit further controls the valve portion V to restrict the distribution of the coolant through the second divergent pathway PB2 when the open failure occurs in the second thermostat 19 while the valve portion V lifts the restriction on the distribution of the coolant through the low-temperature side supply path PL by lifting at least the restriction on the distribution of the coolant through the second divergent pathway PB2. This enables to decrease the flow volume of the coolant distributed through the third portion SG3 when the open failure occurs in the second thermostat 19.

Specifically, the control unit controls the valve portion V to restrict the distribution of the coolant through the second divergent pathway PB2 when the open failure occurs in the second thermostat 19 while the valve portion V lifts the restriction on the distribution of the coolant through the high-temperature side supply pathway PH and lifts the restriction on the distribution of the coolant through the second divergent pathway PB2. This reason is the same as the reason described in the second embodiment.

When controlling the valve portion V to restrict the distribution of the coolant through the second divergent pathway PB2, the control unit specifically controls the valve portion V to lift the restriction on the distribution of the coolant through the high-temperature side supply pathway PH and to restrict the distribution of the coolant through the second divergent pathway PB2. This is because the first thermostat 18 closes when the temperature thw falls below the predetermined value A even though the restriction on the distribution of the coolant through the high-temperature side supply pathway PH is lifted. The control unit may control the valve portion V to restrict both the distribution of the coolant through the high-temperature side supply pathway PH and the distribution of the coolant through the second divergent pathway PB2.

When controlling the valve portion V as described above when the open failure occurs in the second thermostat 19, the control unit controls the valve portion V as described above when the temperature thw falls below a predetermined value H. The predetermined value H may be set to a value less than the predetermined value B. The predetermined value H may be a value changing in accordance with the vehicle speed, the outside air temperature, or the load of the engine 2.

The control unit controls the valve portion V as described above when the temperature thw falls below the predetermined value H, and controls the valve portion V to lift at least the restriction on the distribution of the coolant through the second divergent pathway PB2 when the temperature thw exceeds a predetermined value J. More specifically, the control unit controls the valve portion V to lift both the restriction on the distribution of the coolant through the high-temperature side supply pathway PH and the restriction on the distribution of the coolant through the second divergent pathway PB2. This is in consideration of the fact that the low coolant-temperature control is being performed. The predetermined value J may be set to a value greater than the predetermined value B. It may be also set to a value less than the predetermined value A.

Figure 13:
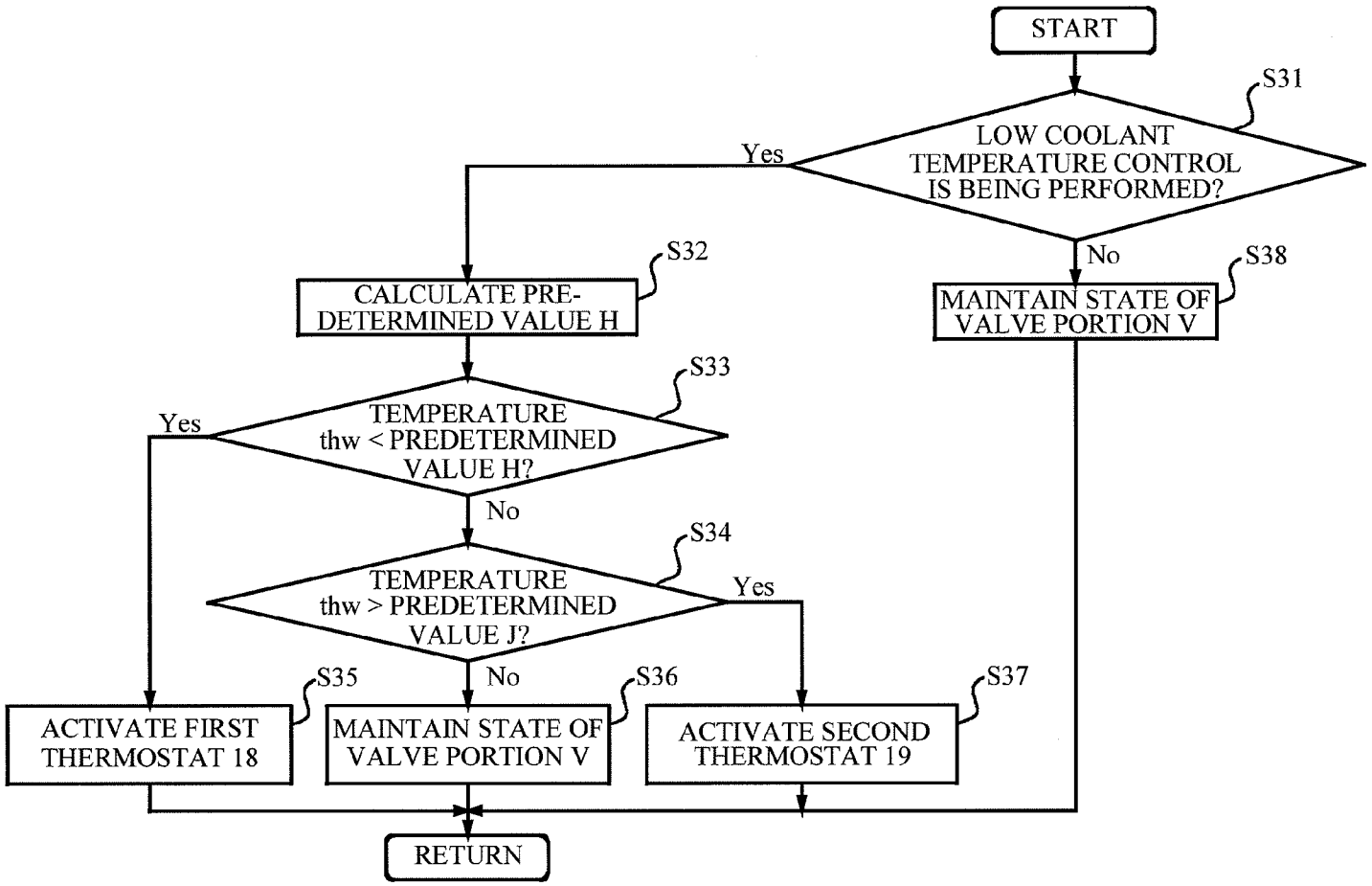
FIG. 13 is a flowchart illustrating a fourth control operation.

A description will next be given of a fourth operation that is the control operation of the fourth fluid control system with reference to a flowchart illustrated in FIG. 13. The ECU 30D determines whether the low coolant-temperature control is being performed (step S31). When the determination at step S31 is No, the ECU 30D maintains the distribution control state of the valve portion V (step S38). At step S38, the distribution control state of the valve portion V is maintained to a state in which the high coolant-temperature control is performed. When the determination at step S31 is Yes, the ECU 30D calculates the predetermined value H (step S32). The predetermined value H can be calculated based on, for example, the vehicle speed, the outside air temperature, or the load of the engine 2.

Subsequent to step S32, the ECU 30D determines whether the temperature thw is less than the predetermined value H (step S33). When the determination is Yes, the process goes to step S35, and the ECU 30D controls the valve portion V so that the distribution control of the coolant by the first thermostat 18 is activated (activate the first thermostat 18). Specifically, at step S35, the ECU 30D controls the valve portion V to lift the restriction on the distribution of the coolant through the high-temperature side supply pathway PH and restrict the distribution of the coolant through the second divergent pathway PB2.

When the determination at step S33 is No, the ECU 30D determines whether the temperature thw exceeds the predetermined value J (step S34). When the determination is No, the ECU 30D maintains the distribution control state of the valve portion V (step S36). On the other hand, when the determination is Yes, the process goes to step S37, and the ECU 30D controls the valve portion V so that the distribution control of the coolant by the second thermostat 19 is activated (activate the second thermostat 19). Specifically, at step S37, the ECU 30D controls the valve portion V to lift both the restriction on the distribution of the coolant through the high-temperature side supply pathway PH and the restriction on the distribution of the coolant through the second divergent pathway PB2. The process goes back to step S31 after steps S35, S36, S37, and S38.

A description will next be given of advantages of the fourth fluid control system. The fourth fluid control system controls the valve portion V to restrict the distribution of the coolant through the second divergent pathway PB2 when the open failure occurs in the second thermostat 19 while the valve portion V lifts the restriction on the distribution of the coolant through the low-temperature side supply path PL by lifting at least the restriction on the distribution of the coolant through the second divergent pathway PB2. This decreases the flow volume of the coolant distributed through the third portion SG3 when the open failure occurs in the second thermostat 19.

Thus, the fourth fluid control system can restrict the supply of the coolant to the engine 2 even when the open failure occurs in the second thermostat 19. As a result, the deterioration of the cooling state of the engine 2 due to the decrease in the temperature thw can be prevented.

Specifically, the fourth fluid control system can control the valve portion V as described above when the open failure occurs in the second thermostat 19 by controlling the valve portion V as described above when the temperature thw falls below the predetermined value H. Further, the fourth fluid control system can regulate the temperature thw between the predetermined values H and J when preventing the deterioration of the cooling state of the engine 2 by controlling the valve portion V to lift the restriction on the distribution of the coolant through the second divergent pathway PB2 when the temperature thw exceeds the predetermined value J.

Figure 14:
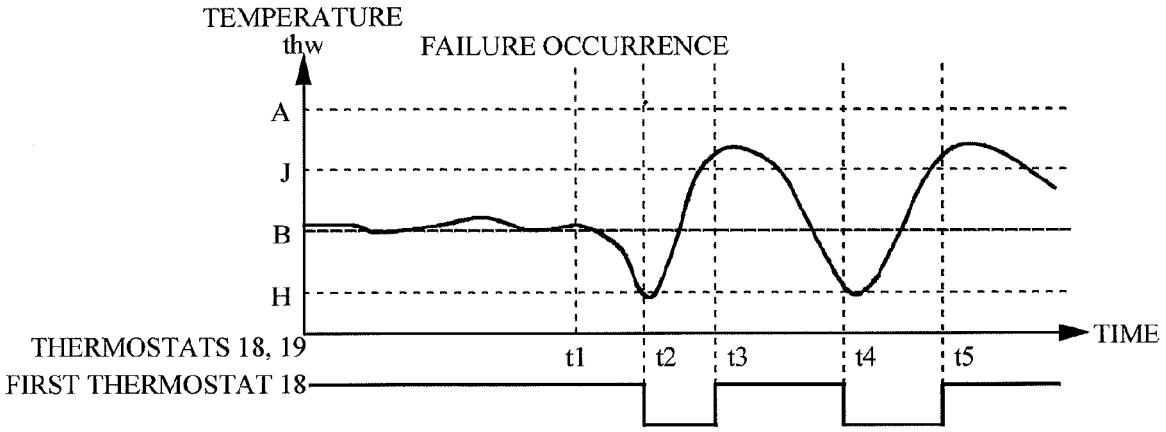
FIG. 14 is a diagram illustrating a change of temperature based on the fourth control operation when the open failure occurs in the second thermostat.

FIG. 14 is a diagram illustrating the change of the temperature thw based on the fourth control operation when the open failure occurs in the second thermostat 19. In FIG. 14, the vertical axis represents the temperature thw, and the horizontal axis represents time. FIG. 14 also presents the thermostats 18, 19 of which the distribution control of the coolant is activated. FIG. 14 illustrates a case in which the open failure occurs in the second thermostat 19 at time t1.

As illustrated in FIG. 14, the temperature thw is regulated to the predetermined value B by the low coolant-temperature control till time t1. On the other hand, when the open failure occurs in the second thermostat 19 at time t1, the supply of the coolant to the engine 2 stops being restricted by the second thermostat 19. As a result, the temperature thw starts decreasing after time t1, and falls below the predetermined value H at time t2.

The valve portion V is controlled so as to restrict the distribution of the coolant through the second divergent pathway PB2 when the temperature thw falls below the predetermined value H. Thus, the supply of the coolant to the engine 2 is restricted. As a result, the temperature thw starts increasing after time t2, and exceeds the predetermined value J at time t3. The valve portion V is controlled so as to lift the restriction on the distribution of the coolant through the second divergent pathway PB2 when the temperature thw exceeds the predetermined value J. Thus, the coolant starts being supplied to the engine 2. As a result, the temperature thw starts decreasing after time t3. At time t4, t5, the temperature thw is regulated as at time t2, t3.

Specifically, the fourth fluid control system controls the valve portion V to lift both the restriction on the distribution of the coolant through the high-temperature side supply pathway PH and the restriction on the distribution of the coolant through the second divergent pathway PB2 when the temperature thw exceeds the predetermined value J. Thus, even when the temperature thw temporarily falls below the predetermined value H by a certain cause, the fourth fluid control system can resume the high coolant-temperature control when the cause disappears. This enables to handle the open failure of the second thermostat 19 by preparing for the open failure of the second thermostat 19 from when the thermostats 18, 19 are normal. That is to say, this enables to eliminate the need for the detection of the open failure of the second thermostat 19.

The fourth fluid control system may be configured not to particularly control the valve portion V when the thermostats 18, 19 are normal during the low coolant-temperature control. To achieve the above configuration, the predetermined value H may be set within a range that the temperature thw never falls below when the thermostats 18, 19 are normal during the high coolant-temperature control. In this case, the predetermined value H is preferably configured to be variable in accordance with a predetermined condition that changes the temperature thw during the low coolant-temperature control (e.g. the vehicle speed, the outside air temperature, or the load of the engine 2).

The fourth fluid control system can prevent the deterioration of the cooling state of the engine 2 due to the decrease in the temperature thw even when the open failure occurs in the first thermostat 18 or the open failure occurs in the second thermostat 19. Moreover, the deterioration of the cooling state of the engine 2 can be prevented even when the open failure or the close failure occurs in one of the thermostats 18, 19.

Figure 7:
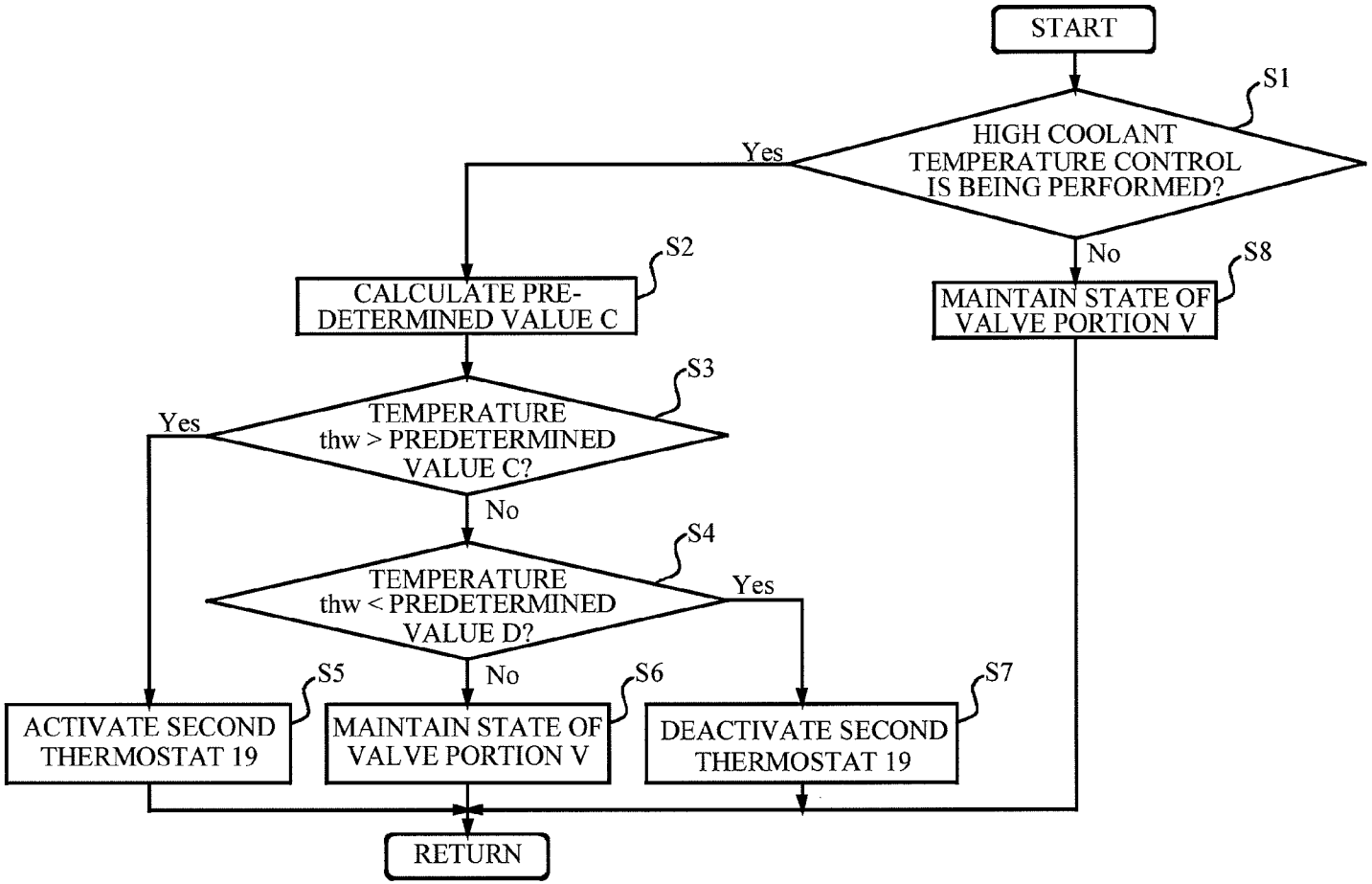
FIG. 7 is a flowchart illustrating a first control operation.
Figure 11:
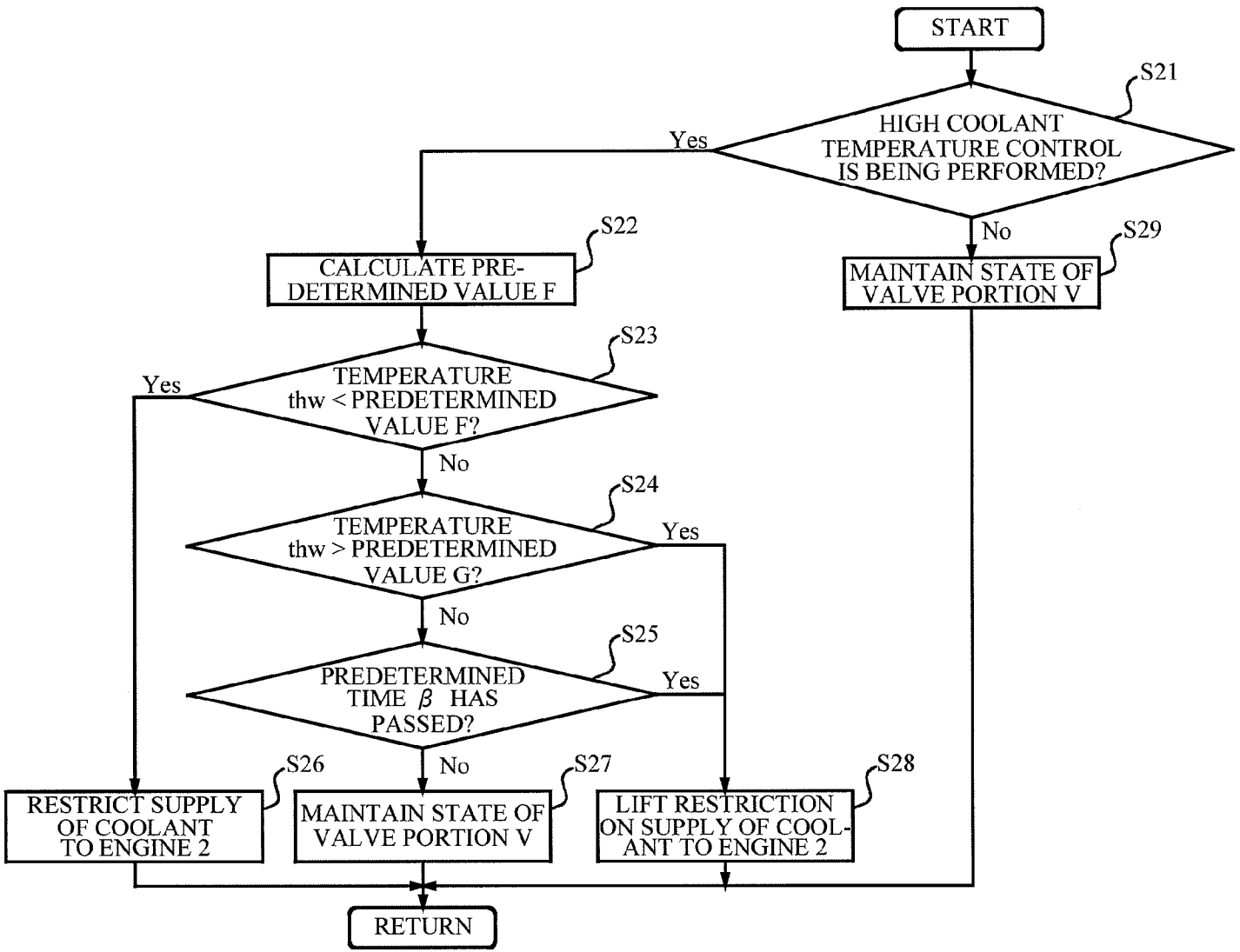
FIG. 11 is a flowchart illustrating a third control operation.

The fourth fluid control system can temporarily deactivate at least the control based on the flowchart illustrated in FIG. 11 out of the control based on the flowcharts illustrated in FIG. 7 and FIG. 11 when the temperature thw exceeds the predetermined value C. The deactivated control can be activated again when the temperature thw does not exceed the predetermined value C several times within a predetermined time period. When the temperature thw falls below the predetermined value F during the high coolant-temperature control, the control based on the flowchart illustrated in FIG. 7 may be deactivated and the control based on the flowchart illustrated in FIG. 11 may be activated. This can apply to the time while the low coolant-temperature control is being performed.

The detailed descriptions have been given of the embodiments of the present invention, but the present invention is not limited to the above-mentioned embodiments, and it is apparent from the above descriptions that other embodiments, variations and modifications may be made without departing from the scope of the present invention.

For example, the valve portion may have a valve mechanism only in the second portion out of the first, second, and third portions. Even in this case, switching between the activation and deactivation of the distribution control of the coolant by the second thermostat enables the distribution control of the coolant by the second thermostat to be performed when the flow control of the coolant by the second thermostat is activated. In addition, when the distribution control of the coolant by the second thermostat is deactivated, the distribution control of the coolant by the first thermostat is enabled to be performed. In this case, the deterioration of the cooling state of the supplying object can be prevented even when the open failure occurs in the second thermostat.

[Description of Letters or Numerals]

W/P 1
engine 2
radiator 6
rotary valve body 13
first thermostat 18
second thermostat 19
ECU 30A, 30B, 30C, 30D
fluid supply pathway PS
first divergent pathway PB 1
second divergent pathway PB2
thermostat portion T
first valve mechanism V1
second valve mechanism V2
valve portion V

The invention claimed is:

1. A fluid control system comprising:

a thermostat portion that includes a first thermostat in a first divergent pathway and a second thermostat of which an open valve temperature is set to be less than that of the first thermostat in a second divergent pathway, the first and second divergent pathways diverging and then converging;

a valve portion that includes a valve mechanism in at least a second portion out of a first portion that is a portion located more downstream than the first thermostat in the first divergent pathway, the second portion that is a portion located more downstream than the second thermostat in the second divergent pathway, and a third portion that is a portion lying posterior to a point at which the first and second divergent pathways converge in a fluid supply pathway that includes the first and second divergent pathways and supplies a fluid to a supplying object; and a control unit that controls the valve portion to switch a distribution control state of at least one valve mechanism of the valve mechanism of the valve portion when one of an open failure that causes a thermostat to be kept open and a close failure that causes a thermostat to be kept closed occurs in one of the first and second thermostats, wherein the control unit controls the valve portion to decrease a flow volume of the fluid distributed through the third portion by controlling the valve portion to switch the distribution control state of at least one valve mechanism of the valve mechanism of the valve portion when the open failure occurs in one of the first and second thermostats.

2. The fluid control system according to claim 1, wherein the control unit controls, when the close failure occurs in one thermostat of the first and second thermostats, the valve portion to increase a flow volume of the fluid distributed through another thermostat by switching the distribution control state of at least one valve mechanism of the valve mechanism of the valve portion.

3. The fluid control system according to claim 2, wherein the control unit increases a flow volume of the fluid distributed through the second thermostat by controlling the valve portion to lift at least a restriction on distribution of the fluid through the second divergent pathway when the close failure occurs in the first thermostat while the valve portion restricts at least the distribution of the fluid through the second divergent pathway and does not restrict distribution of the fluid through a high-temperature side supply pathway that is capable of supplying the fluid to the supplying object through the first divergent pathway in the fluid supply pathway.

4. The fluid control system according to claim 2, further comprising:

a cooler that cools the fluid flowing at upstream sides of the first and second divergent pathways;

a bypass pathway that distributes the fluid around the cooler to a portion located more downstream than the second thermostat in the second divergent pathway; and a bypass valve that operates in conjunction mechanically with the second thermostat, and opens the bypass pathway when the second thermostat is closed and blocks the bypass pathway when the second thermostat is open, wherein the valve portion includes a valve mechanism in at least the second portion, the valve mechanism being located more downstream than the bypass valve in the second portion, and the control unit increases a flow volume of the fluid distributed through the first thermostat by controlling the valve portion to restrict at least the distribution of the fluid through the second divergent pathway when the close failure occurs in the second thermostat while the valve portion lifts a restriction on distribution of the fluid through a low-temperature side supply path that is capable of supplying the fluid to the supplying object through the second divergent pathway in the fluid supply pathway by lifting at least a restriction on the distribution of the fluid through the second divergent pathway.

5. The fluid control system according to claim 2, wherein the valve portion includes valve mechanisms in two portions, including the second portion, out of the first, second, and third portions.

6. The fluid control system according to claim 1, wherein the valve portion includes valve mechanisms in two or more portions, including the second portion, out of the first, second, and third portions, and the control unit decreases a flow volume of the fluid distributed through the third portion by controlling the valve portion to restrict at least distribution of the fluid through a high-temperature side supply pathway when the open failure occurs in the first thermostat while the valve portion lifts a restriction on the distribution of the fluid through the high-temperature side supply pathway that is capable of supplying the fluid to the supplying object through the first divergent pathway in the fluid supply pathway and restricts distribution of the fluid through the second divergent pathway.

7. The fluid control system according to claim 1, wherein the control unit decreases a flow volume of the fluid distributed through the third portion by controlling the valve portion to restrict distribution of the fluid through the second divergent pathway when the open failure occurs in the second thermostat while the valve portion lifts a restriction on distribution of the fluid through a low-temperature side supply path that is capable of supplying the fluid to the supplying object through the second divergent pathway in the fluid supply pathway by lifting at least the restriction on the distribution of the fluid through the second divergent pathway.

8. The fluid control system according to claim 1, wherein the valve portion includes a single-axis rotary valve body located in two portions, including the second portion, of the first, second, and third portions to include respective valve mechanisms in the two portions, including the second portions, of the first, second, and third portions.

* * * * *